US008118667B2

(12) United States Patent
Herrmann

(10) Patent No.: US 8,118,667 B2
(45) Date of Patent: Feb. 21, 2012

(54) MULTIPLAYER GAMING INCENTIVE

(75) Inventor: Mark E. Herrmann, Wellesley, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 181 days.

(21) Appl. No.: 12/473,531

(22) Filed: May 28, 2009

(65) Prior Publication Data

US 2010/0016069 A1 Jan. 21, 2010

Related U.S. Application Data

(63) Continuation-in-part of application No. 11/780,882, filed on Jul. 20, 2007, said application No. 12/473,531 is a continuation-in-part of application No. 11/704,144, filed on Feb. 8, 2007, now Pat. No. 8,016,668, said application No. 12/473,531 is a continuation-in-part of application No. 11/840,541, filed on Aug. 17, 2007, now Pat. No. 8,029,361, which is a continuation of application No. 11/780,882, said application No. 12/473,531 is a continuation-in-part of application No. 12/238,849, filed on Sep. 26, 2008.

(60) Provisional application No. 60/928,855, filed on May 11, 2007, provisional application No. 60/838,234, filed on Aug. 17, 2006, provisional application No. 60/771,505, filed on Feb. 8, 2006, provisional application No. 61/056,668, filed on May 28, 2008.

(51) Int. Cl.
*A63F 9/24* (2006.01)

(52) U.S. Cl. ..... 463/25; 463/16; 463/29

(58) Field of Classification Search ..... 463/16, 463/20, 25, 29
See application file for complete search history.

(56) References Cited

U.S. PATENT DOCUMENTS

| | | | |
|---|---|---|---|
| 2,544,961 | A | 3/1951 | Kemp |
| 4,215,864 | A | 8/1980 | Nichols |
| 4,494,197 | A | 1/1985 | Troy et al. |
| 4,582,324 | A | 4/1986 | Koza et al. |
| 4,679,789 | A | 7/1987 | Okada |
| 4,689,742 | A | 8/1987 | Troy et al. |
| 4,725,079 | A | 2/1988 | Koza et al. |
| 4,764,666 | A | 8/1988 | Bergeron |

(Continued)

FOREIGN PATENT DOCUMENTS

| | | |
|---|---|---|
| CA | 2338080 | 9/2001 |

(Continued)

OTHER PUBLICATIONS

Rules of Pai Gow Poker. Casino City. Dec. 3, 2000. Online: http://web.archive.org/web/20001203170300/http://www.casinocity.com/rule/paigow.htm.

(Continued)

*Primary Examiner* — Omkar Deodhar
(74) *Attorney, Agent, or Firm* — Dority & Manning, P.A.

(57) ABSTRACT

A system and method is provided for incentivizing players to visit a gambling location. In one aspect, a qualified person is invited to play in a multiplayer game which has a stated jackpot award. In one embodiment, the qualified person may be required to accept the invitation at a gambling location. According to one embodiment, a player may be required to maintain their qualified status through play of games at the gambling location. According to another embodiment, the multiplayer game is capable of accommodating an almost unlimited number of players. In one example, the multiplayer game is a bingo game with a large number of participants.

31 Claims, 9 Drawing Sheets

U.S. PATENT DOCUMENTS

| | | | | |
|---|---|---|---|---|
| 4,856,787 | A * | 8/1989 | Itkis | |
| 4,882,473 | A | 11/1989 | Bergeron et al. | |
| 4,922,522 | A | 5/1990 | Scanlon | |
| 5,158,293 | A | 10/1992 | Mullins | |
| 5,324,035 | A | 6/1994 | Morris et al. | |
| 5,351,970 | A * | 10/1994 | Fioretti | |
| 5,373,440 | A | 12/1994 | Cohen | |
| 5,377,975 | A | 1/1995 | Clapper, Jr. | |
| 5,398,932 | A | 3/1995 | Eberhardt et al. | |
| 5,429,361 | A | 7/1995 | Raven | |
| 5,445,391 | A * | 8/1995 | Gleason | |
| 5,518,253 | A * | 5/1996 | Pocock et al. | |
| 5,569,082 | A | 10/1996 | Kaye | |
| 5,586,937 | A | 12/1996 | Menashe | |
| 5,611,729 | A * | 3/1997 | Schumacher | |
| 5,628,684 | A | 5/1997 | Bouedec | |
| 5,645,485 | A | 7/1997 | Clapper, Jr. | |
| 5,653,635 | A | 8/1997 | Breeding | |
| 5,655,961 | A * | 8/1997 | Acres et al. | 463/27 |
| 5,687,971 | A | 11/1997 | Khadadkar | |
| 5,709,603 | A | 1/1998 | Kaye | |
| 5,722,891 | A | 3/1998 | Inoue | |
| 5,749,784 | A | 5/1998 | Clapper, Jr. | |
| 5,768,382 | A | 6/1998 | Schneier et al. | |
| 5,772,511 | A | 6/1998 | Smeltzer | |
| 5,775,993 | A | 7/1998 | Fentz | |
| 5,779,549 | A * | 7/1998 | Walker et al. | |
| 5,788,573 | A | 8/1998 | Baerlocher et al. | |
| 5,791,990 | A | 8/1998 | Schroeder et al. | |
| 5,791,991 | A * | 8/1998 | Small | |
| 5,797,795 | A | 8/1998 | Takemoto | |
| 5,810,664 | A | 9/1998 | Clapper, Jr. | |
| 5,816,918 | A | 10/1998 | Kelly et al. | |
| 5,823,873 | A | 10/1998 | Moody | |
| 5,823,874 | A | 10/1998 | Adams | |
| 5,830,069 | A | 11/1998 | Soltesz et al. | |
| 5,848,932 | A | 12/1998 | Adams | |
| 5,860,653 | A | 1/1999 | Jacobs | |
| 5,871,398 | A | 2/1999 | Schneier et al. | |
| 5,882,258 | A | 3/1999 | Kelly et al. | |
| 5,887,906 | A | 3/1999 | Sultan | |
| 5,928,082 | A | 7/1999 | Clapper, Jr. et al. | |
| 5,944,606 | A | 8/1999 | Gerow | |
| 5,954,582 | A | 9/1999 | Zach et al. | |
| 5,980,385 | A * | 11/1999 | Clapper | |
| 5,996,997 | A * | 12/1999 | Kamille | |
| 6,007,426 | A | 12/1999 | Kelly et al. | |
| 6,012,983 | A | 1/2000 | Walker et al. | |
| 6,015,344 | A | 1/2000 | Kelly et al. | |
| 6,024,640 | A | 2/2000 | Walker et al. | |
| 6,028,920 | A | 2/2000 | Carson | |
| 6,044,135 | A | 3/2000 | Katz | |
| 6,048,269 | A | 4/2000 | Burns et al. | |
| 6,056,289 | A * | 5/2000 | Clapper | |
| 6,059,289 | A | 5/2000 | Vancura | |
| 6,077,163 | A | 6/2000 | Walker et al. | |
| 6,106,393 | A | 8/2000 | Sunaga et al. | |
| 6,113,495 | A | 9/2000 | Walker et al. | |
| 6,146,272 | A | 11/2000 | Walker et al. | |
| 6,152,823 | A | 11/2000 | Lacoste et al. | |
| 6,159,097 | A | 12/2000 | Gura | |
| 6,162,121 | A | 12/2000 | Morro et al. | |
| 6,168,521 | B1 | 1/2001 | Luciano et al. | |
| 6,173,267 | B1 | 1/2001 | Cairns | |
| 6,179,711 | B1 | 1/2001 | Yoseloff | |
| 6,186,892 | B1 | 2/2001 | Frank et al. | |
| 6,193,608 | B1 | 2/2001 | Walker | |
| 6,203,011 | B1 | 3/2001 | Nulph et al. | |
| 6,203,427 | B1 | 3/2001 | Walker et al. | |
| 6,236,900 | B1 | 5/2001 | Geiger | |
| 6,241,606 | B1 | 6/2001 | Riendeau et al. | |
| 6,244,958 | B1 | 6/2001 | Acres et al. | |
| 6,251,017 | B1 | 6/2001 | Leason et al. | |
| 6,270,406 | B1 * | 8/2001 | Sultan | |
| 6,273,817 | B1 * | 8/2001 | Sultan | |
| 6,279,911 | B1 * | 8/2001 | Cherry | |
| 6,280,325 | B1 * | 8/2001 | Fisk | |
| RE37,371 | E * | 9/2001 | Gerow | |
| 6,283,855 | B1 | 9/2001 | Bingham | |
| 6,287,197 | B1 | 9/2001 | Dickinson | |
| 6,302,793 | B1 | 10/2001 | Fertitta et al. | |
| 6,309,298 | B1 * | 10/2001 | Gerow | |
| 6,311,976 | B1 | 11/2001 | Yoseloff et al. | |
| 6,312,334 | B1 | 11/2001 | Yoseloff | |
| 6,358,151 | B1 | 3/2002 | Enzminger et al. | |
| 6,364,765 | B1 | 4/2002 | Walker et al. | |
| 6,364,766 | B1 | 4/2002 | Anderson | |
| 6,368,214 | B1 | 4/2002 | Luciano | |
| 6,368,218 | B2 | 4/2002 | Angell, Jr. | |
| 6,371,852 | B1 | 4/2002 | Acres | |
| 6,375,567 | B1 | 4/2002 | Acres | |
| 6,390,921 | B1 | 5/2002 | Busch et al. | |
| 6,394,902 | B1 | 5/2002 | Glavich et al. | |
| 6,402,614 | B1 | 6/2002 | Schneier et al. | |
| 6,439,995 | B1 | 8/2002 | Hughs-Baird et al. | |
| 6,471,208 | B2 | 10/2002 | Yoseloff et al. | |
| 6,488,280 | B1 | 12/2002 | Katz et al. | |
| 6,514,144 | B2 | 2/2003 | Riendeau et al. | |
| 6,523,829 | B1 | 2/2003 | Walker et al. | |
| 6,527,175 | B1 | 3/2003 | Dietz et al. | |
| 6,540,230 | B1 | 4/2003 | Walker et al. | |
| 6,565,084 | B1 | 5/2003 | Katz et al. | |
| 6,572,106 | B2 | 6/2003 | Alexoff et al. | |
| 6,572,107 | B1 | 6/2003 | Walker et al. | |
| 6,575,832 | B1 | 6/2003 | Manfredi et al. | |
| 6,582,307 | B2 | 6/2003 | Webb | |
| 6,582,310 | B1 | 6/2003 | Walker et al. | |
| 6,588,747 | B1 | 7/2003 | Seelig | |
| 6,595,854 | B2 | 7/2003 | Hughs-Baird | |
| 6,599,187 | B2 * | 7/2003 | Gerow | |
| 6,599,192 | B1 | 7/2003 | Baerlocher et al. | |
| 6,607,439 | B2 | 8/2003 | Schneier et al. | |
| 6,612,501 | B1 | 9/2003 | Woll et al. | |
| 6,612,574 | B1 | 9/2003 | Cole et al. | |
| 6,619,660 | B2 | 9/2003 | Schaefer et al. | |
| 6,620,046 | B2 | 9/2003 | Rowe | |
| 6,625,578 | B2 | 9/2003 | Spaur et al. | |
| 6,645,074 | B2 | 11/2003 | Thomas et al. | |
| 6,645,075 | B1 * | 11/2003 | Gatto | |
| 6,656,042 | B2 | 12/2003 | Reiss et al. | |
| 6,663,105 | B1 | 12/2003 | Sullivan et al. | |
| 6,676,126 | B1 | 1/2004 | Walker et al. | |
| 6,679,497 | B2 | 1/2004 | Walker et al. | |
| 6,681,995 | B2 | 1/2004 | Sukeda et al. | |
| 6,682,419 | B2 | 1/2004 | Webb et al. | |
| D486,869 | S | 2/2004 | Webb et al. | |
| 6,685,561 | B2 | 2/2004 | Anderson et al. | |
| 6,692,353 | B2 | 2/2004 | Walker et al. | |
| 6,705,944 | B2 | 3/2004 | Luciano | |
| 6,716,103 | B1 | 4/2004 | Eck et al. | |
| 6,719,631 | B1 | 4/2004 | Tulley et al. | |
| 6,729,956 | B2 | 5/2004 | Wolf et al. | |
| 6,733,385 | B1 | 5/2004 | Enzminger et al. | |
| 6,736,324 | B2 * | 5/2004 | Behm | |
| 6,749,198 | B2 | 6/2004 | Katz et al. | |
| 6,761,633 | B2 | 7/2004 | Riendeau et al. | |
| 6,786,824 | B2 | 9/2004 | Cannon | |
| 6,811,484 | B2 | 11/2004 | Katz et al. | |
| 6,824,467 | B2 | 11/2004 | Schlottmann et al. | |
| 6,843,724 | B2 | 1/2005 | Walker et al. | |
| 6,852,031 | B1 | 2/2005 | Rowe et al. | |
| 6,855,052 | B2 | 2/2005 | Weiss et al. | |
| 6,866,584 | B2 | 3/2005 | Michaelson | |
| 6,896,619 | B2 * | 5/2005 | Baltz | |
| 6,899,622 | B2 | 5/2005 | Lind et al. | |
| 6,910,968 | B2 | 6/2005 | Nassef et al. | |
| 6,913,534 | B2 * | 7/2005 | DeFrees-Parrott | |
| 6,918,589 | B2 | 7/2005 | Thibault | |
| 6,929,544 | B2 | 8/2005 | Osterer | |
| 6,934,846 | B2 * | 8/2005 | Szrek | |
| 6,942,570 | B2 | 9/2005 | Schneier et al. | |
| 6,969,319 | B2 | 11/2005 | Rowe et al. | |
| 7,008,317 | B2 | 3/2006 | Cote et al. | |
| 7,008,318 | B2 | 3/2006 | Schneier et al. | |
| 7,024,375 | B2 * | 4/2006 | Chau | |
| 7,073,720 | B2 * | 7/2006 | Behm | |
| 7,094,149 | B2 | 8/2006 | Walker | |

7,112,135 B2 * 9/2006 Anderson
7,118,478 B2 10/2006 Fayter et al.
7,163,459 B2 1/2007 Tanskanen et al.
7,172,506 B2 2/2007 Baerlocher et al.
7,179,168 B1 2/2007 Tulley et al.
7,186,180 B2 * 3/2007 Lathrop
7,213,811 B2 * 5/2007 Bozeman
7,241,219 B2 7/2007 Walker
7,275,990 B2 10/2007 Walker et al.
7,285,045 B2 10/2007 Schneier et al.
7,294,058 B1 11/2007 Slomiany et al.
7,303,468 B2 12/2007 Schneier et al.
7,303,470 B2 12/2007 George et al.
7,311,599 B2 * 12/2007 Knapp
7,357,393 B2 * 4/2008 Finocchio
7,416,484 B1 * 8/2008 Nelson
7,490,830 B2 2/2009 Mirandette
2001/0034635 A1 10/2001 Winters
2001/0046891 A1 11/2001 Acres
2001/0049305 A1 12/2001 Riendeau et al.
2002/0010015 A1 1/2002 Acres
2002/0013167 A1 1/2002 Spaur et al.
2002/0039923 A1 * 4/2002 Cannon et al. ..... 463/42
2002/0042300 A2 4/2002 Acres et al.
2002/0052229 A1 5/2002 Halliburton et al.
2002/0061778 A1 5/2002 Acres
2002/0077173 A1 6/2002 Luciano et al.
2002/0090986 A1 7/2002 Cote et al.
2002/0090987 A1 7/2002 Walker et al.
2002/0093190 A1 * 7/2002 Katz
2002/0098882 A1 7/2002 Lind et al.
2002/0107072 A1 8/2002 Giobbi et al.
2002/0147040 A1 10/2002 Walker et al.
2002/0152120 A1 10/2002 Howington et al.
2002/0155885 A1 10/2002 Shvili
2002/0169018 A1 11/2002 Schneier et al.
2002/0187827 A1 12/2002 Blankstein
2002/0193158 A1 12/2002 Weiss et al.
2002/0198038 A1 12/2002 Adams
2003/0013531 A1 1/2003 Rowe et al.
2003/0027628 A1 2/2003 Luciano
2003/0032473 A1 2/2003 Rowe et al.
2003/0032476 A1 2/2003 Walker et al.
2003/0045340 A1 3/2003 Roberts
2003/0047869 A1 3/2003 Walker et al.
2003/0060257 A1 3/2003 Katz et al.
2003/0060261 A1 3/2003 Katz et al.
2003/0060264 A1 3/2003 Chilton et al.
2003/0069068 A1 4/2003 Kaminkow
2003/0080508 A1 5/2003 Thibault
2003/0102625 A1 6/2003 Katz et al.
2003/0114217 A1 6/2003 Walker et al.
2003/0119581 A1 * 6/2003 Cannon et al. ..... 463/25
2003/0139214 A1 7/2003 Wolf et al.
2003/0155715 A1 8/2003 Walker et al.
2003/0157977 A1 8/2003 Thomas et al.
2003/0171986 A1 * 9/2003 Itkis
2003/0176210 A1 9/2003 Vancura et al.
2003/0176212 A1 9/2003 Schlottmann et al.
2003/0184012 A1 10/2003 Green
2003/0186739 A1 10/2003 Paulsen et al.
2003/0195841 A1 10/2003 Ginsberg et al.
2003/0199318 A1 10/2003 Nassef et al.
2003/0218303 A1 11/2003 Walker et al.
2003/0220138 A1 11/2003 Walker et al.
2004/0025190 A1 2/2004 McCalla et al.
2004/0036212 A1 2/2004 Walker et al.
2004/0038723 A1 2/2004 Schneier et al.
2004/0051240 A1 3/2004 Adams
2004/0053683 A1 3/2004 Hartl et al.
2004/0059445 A1 3/2004 Moore
2004/0063484 A1 4/2004 Dreaper et al.
2004/0092307 A1 5/2004 George et al.
2004/0102238 A1 5/2004 Taylor
2004/0102239 A1 5/2004 Samila
2004/0127279 A1 7/2004 Gatto et al.
2004/0133472 A1 7/2004 Leason et al.
2004/0142741 A1 7/2004 Walker et al.
2004/0147308 A1 7/2004 Walker et al.
2004/0152504 A1 8/2004 Herrmann et al.
2004/0152510 A1 * 8/2004 Herrmann
2004/0180722 A1 9/2004 Giobbi et al.
2004/0185930 A1 9/2004 Thomas et al.
2004/0204222 A1 10/2004 Roberts
2004/0214628 A1 10/2004 Boyd et al.
2004/0229671 A1 11/2004 Stronach et al.
2004/0229677 A1 11/2004 Gray
2004/0259629 A1 12/2004 Michaelson et al.
2004/0259631 A1 12/2004 Katz et al.
2005/0037841 A1 2/2005 de Waal et al.
2005/0049042 A1 3/2005 Walker et al.
2005/0075158 A1 4/2005 Walker et al.
2005/0090314 A1 4/2005 Nassef, Jr. et al.
2005/0092839 A1 * 5/2005 Oram
2005/0124407 A1 6/2005 Rowe et al.
2005/0164779 A1 * 7/2005 Okuniewicz
2005/0170881 A1 8/2005 Muskin
2005/0187005 A1 8/2005 Rose et al.
2005/0258596 A1 11/2005 Such
2005/0282619 A1 12/2005 Vancura et al.
2005/0282626 A1 12/2005 Manfredi et al.
2005/0288088 A1 12/2005 Englman et al.
2006/0025219 A1 2/2006 Nassef et al.
2006/0035696 A1 2/2006 Walker et al.
2006/0036450 A1 2/2006 Nassef, Jr. et al.
2006/0041586 A1 2/2006 Nassef, Jr. et al.
2006/0068893 A1 3/2006 Jaffe et al.
2006/0073884 A1 4/2006 Walker et al.
2006/0079331 A1 4/2006 Moshal
2006/0089194 A1 4/2006 Joshi et al.
2006/0148562 A1 7/2006 Walker et al.
2006/0194631 A1 8/2006 Rowe et al.
2006/0205461 A1 9/2006 Larocca et al.
2006/0205511 A1 9/2006 Thomas et al.
2006/0247035 A1 11/2006 Rowe et al.
2007/0054729 A1 3/2007 Hornik et al.
2007/0060261 A1 3/2007 Gomez et al.
2007/0060274 A1 3/2007 Rowe et al.
2007/0060317 A1 3/2007 Martin et al.
2007/0060329 A1 3/2007 Martin et al.
2007/0060330 A1 3/2007 Martin et al.
2007/0060331 A1 3/2007 Martin et al.
2007/0060369 A1 3/2007 Martin et al.
2007/0087834 A1 4/2007 Moser et al.
2007/0167216 A1 7/2007 Walker et al.
2007/0173322 A1 7/2007 Swamy et al.
2007/0254736 A1 11/2007 Hardy et al.
2007/0265062 A1 11/2007 Thomas et al.
2008/0032763 A1 2/2008 Giobbi et al.
2008/0039171 A1 2/2008 Slomiany et al.
2008/0039173 A1 2/2008 Walther et al.
2008/0287176 A1 * 11/2008 Bennett

FOREIGN PATENT DOCUMENTS

EP 1746550 A2 1/2004
EP 1762990 A2 3/2007
EP 1833014 A1 9/2007
WO PCT/FI90/00254 10/1990
WO WO 91/06931 5/1991
WO WO 97/37737 A1 10/1997
WO WO 99/10057 A1 3/1999
WO WO 99/16519 A1 4/1999
WO WO 00/43087 A1 7/2000
WO WO 00/69535 A1 11/2000
WO WO 01/14029 A1 3/2001
WO WO 03/004118 A1 1/2003
WO WO 03/061795 A1 7/2003
WO WO 03/084625 A1 10/2003
WO WO 03/089077 A1 10/2003
WO WO 03/089082 A1 10/2003
WO WO 2004/013820 A2 2/2004
WO WO 2004/105902 9/2004
WO WO 2004/114073 A2 12/2004
WO WO 2005/029279 A2 3/2005
WO WO 2005/031666 A1 4/2005
WO WO 2005/079242 A2 9/2005
WO WO 2006/028820 A1 3/2006
WO WO 2006/052469 A2 5/2006

| | | | |
|---|---|---|---|
| WO | WO 2007/035618 | A2 | 3/2007 |
| WO | WO 2007/040707 | A2 | 4/2007 |
| WO | WO 2007/076321 | A2 | 7/2007 |
| WO | WO 2007/145999 | A2 | 12/2007 |
| WO | WO 2008/014334 | A2 | 1/2008 |
| WO | WO 2008/022083 | A2 | 2/2008 |
| WO | WO 2008/022084 | A2 | 2/2008 |

OTHER PUBLICATIONS

H.X. Mel and Doris Baker, Cryptography Decrypted, 2001 Addison Wesly, chapters 9 to 12.

Virginia Lottery games, downloaded from www.archive.org, Apr. 29, 2007.

Pop Cap Games, Bejeweled, Feb. 3, 2005, http://web.archive.org/web/20050203202244/http://www.go2share.net/game/bejeweled/index.htm.

John Scarne, Scarne's Complete Guide to Gambling, 1961, Simon & Schuster, New York, chapter 4 on lotteries, pp. 125-126.

Wikipedia, "Wheel of Fortune (US Game Show)" Wikipedia, Nov. 13, 2007 <http://en.wikipedia.org/wiki/Wheel_of_Fortune_%28US_game_show%29>.

New Jersey, State Of, "Wheel of Fortune" New Jersey Lottery, Nov. 13, 2007 <http://www.state.nj.us/lottery/instant/ig409.htm>.

New Jersey, State Of, "Lots O' Spots Bingo" New Jersey Lottery, Dec. 6, 2007 <http://www.state.nj.us/lottery/instant/ig340.htm>.

http://www.powerball.com/powerball/pb_howtoplay.asp, accessed Sep. 14, 2008, All.

Written Opinion of the International Searching Authority (International application No. PCT/US07/76224).

Examiner's first report on patent application No. 2003298941.

Bejeweled Deluxe, Version 1.87, Developed and published by PopCap Games, Inc., www. Popcap.com, http://www.popcap.com/faq/bejeweled/1033/pc/readme.html (1 of8) Feb. 25, 2010 9:14:22 AM.

David, Matthew, Online Games Deelopment in Flash—A Brief history, Apr. 28, 2003, SitePoint, http://araticles.sitepoint.com/print/flash-brief-history (1 of 6) Jun. 18, 2010 8:28:50AM.

* cited by examiner

MULTIPLAYER GAMING INCENTIVE

RELATED APPLICATIONS

This application is a continuation-in-part of, and claims priority under 35 U.S.C. §120 U.S. patent application Ser. No. 11/780,882 entitled "METHOD AND APPARATUS FOR PROVIDING PLAYER INCENTIVES," filed on Jul. 20, 2007, which claims priority under 35 U.S.C. 119(e) to U.S. Provisional Application Ser. No. 60/928,855, entitled "METHOD AND APPARATUS FOR PROVIDING PLAYER INCENTIVES," filed May 11, 2007, and to U.S. Provisional Application Ser. No. 60/838,234, entitled "METHOD AND APPARATUS FOR CONDUCTING A GAME OF CHANCE," filed Aug. 17, 2006, which applications are incorporated herein by reference in their entirety. This application is also a continuation-in-part of, and claims priority under 35 U.S.C. §120 to U.S. patent application Ser. No. 11/704,144, entitled "METHOD AND SYSTEM FOR REMOTE ENTRY IN FREQUENT PLAYER PROGRAMS," filed on Feb. 8, 2007 which claims priority under 35 U.S.C. 119(e) to U.S. Provisional Application Ser. No. 60/771,505, entitled "METHOD AND SYSTEM FOR REMOTE ENTRY IN FREQUENT PLAYER PROGRAMS," filed on Feb. 8, 2006 and to U.S. Provisional Application Ser. No. 60/838,234, entitled "METHOD AND APPARATUS FOR CONDUCTING A GAME OF CHANCE," filed Aug. 17, 2006, which applications are herein incorporated by reference in their entirety. Furthermore, this application is also a continuation-in-part of, and claims priority under 35 U.S.C. §120 to U.S. patent application Ser. No. 11/840,541 entitled "METHOD AND APPARATUS FOR PROVIDING PLAYER INCENTIVES," filed on Aug. 17, 2007, which claims priority under 35 U.S.C. 119(e) to U.S. Provisional Application Ser. No. 60/928,855, entitled "METHOD AND APPARATUS FOR PROVIDING PLAYER INCENTIVES," filed May 11, 2007, and to U.S. Provisional Application Ser. No. 60/838,234, entitled "METHOD AND APPARATUS FOR CONDUCTING A GAME OF CHANCE," filed Aug. 17, 2006, application Ser. No. 11/840,541 is a continuation of U.S. patent application Ser. No. 11/780,882 entitled "METHOD AND APPARATUS FOR PROVIDING PLAYER INCENTIVES," filed on Jul. 20, 2007, each of which applications are incorporated by reference herein in their entirety. This application is also a continuation-in-part of, and claims priority under 35 U.S.C. §120 to U.S. patent application Ser. No. 12/238,849 entitled "METHOD AND APPARATUS FOR PROVIDING PLAYER INCENTIVES," filed on Sep. 26, 2008, which application is incorporated by reference herein in its entirety. This application also claims priority under 35 U.S.C. 119(e) to U.S. Provisional Application Ser. No. 61/056,668, entitled "MULTIPLAYER GAMING INCENTIVE," filed May 28, 2008, incorporated herein by reference in its entirety.

BACKGROUND

People enjoy playing games and often regard a prize won by playing a game to be more valuable than that of the prize itself. Just the chance to win a prize provides considerable entertainment. Games are often used to induce persons to visit a location order to obtain a game entry, check game outcomes and/or redeem prizes won. The well-known McDonalds restaurant, for example, provides scratch-off game cards with prizes of cash and other awards as prizes. Such scratch-off tickets are provided free of charge without a purchase requirement. To obtain a free game card, people need only to visit a local McDonalds location.

Casinos sometimes issue free or reduced price wagers to entice people to visit a casino location. For example, an enticement of $20 in free play might be included in a direct mail piece. A person that receives such a mailer can simply bring the mailer to a designated casino location within defined time limits and receive that amount in coins, free credits on a gaming machine or promotional chips for play on table games. While such offers are enticing, they often are not strong enough to overcome the effort of returning to the casino and often times, people simply forget about the offer and do not return within the allotted time to collect their incentive.

Some casinos offer promotional games on the casino floor, wherein players redeem their free credit entitlement in the form of a game which can randomly award one of several amounts of free credits for casino game play, which are redeemable immediately or at a later time to encourage return visits. In some cases, the person must return at a later time just to learn the award value. People are sometimes reluctant to revisit the casino to learn of a prize value or to collect a prize due to the passage of time, disengagement from the game process or simple forgetfulness. Player tracking systems, such as International Game Technology's Advantage system and Bally Technology's Slot Management System and Table Management System are also well known. Player tracking systems are useful for automating some or all of the tasks required to provide additional incentives for frequent or loyal play. For example, points may be awarded for every unit of wagers made and those points may be redeemed for prizes.

Player tracking systems utilize magnetic striped cards to hold a unique identifier which is associated with a specific person's account. Each gambling machine and/or table game position is equipped with a compatible card reader. A person wishing to allow their gambling activities to be monitored inserts their card into the compatible card reader. Other identification techniques are also useful with player tracking systems and include but are not limited to biometric identification, smart cards and Hollerith cards.

In some cases, additional identity authentication is required such as entering a PIN or password on a keypad or touchscreen. Most player tracking systems, include a display which provides acknowledgment that the card was accurately read and associated with an account. Typically, for so long as the person's card remains inserted in the reader, all gambling activity that occurs on the associated gambling game is recorded on the identified account.

All card readers and displays associated with the player tracking systems are connected via a network to one or more central servers where account records are kept. Two way communication is provided by these networks, meaning the central server can monitor what is transpiring at the gaming system and the central server may pass messages to the gaming system itself, or its associated peripherals. Player tracking systems are well-known in the gambling industry. Example player tracking system architectures are found in U.S. Pat. No. 5,429,361 entitled "Gaming machine information, communication and display system" and U.S. Pat. No. 5,655,961 entitled "Method for operating networked gaming devices," both of which are herein incorporated by reference. Player tracking systems are also used to automatically provide awards to players as described in U.S. Pat. No. 6,712,697 entitled "Method for crediting a player of an electronic gaming device" which is also incorporated by reference herein.

A key to any successful gaming operation includes getting players to visit the gambling location, and once there encouraging the players to gamble more. Providing chances to win a prize as discussed above is just one form of incentive to induce, seduce, or convince a player to visit a gambling location. Player club rewards may serve the same function and encourage increased gambling. Additionally, bonus round games are also typically thought to encourage player participation and certain known bonus games provide for player participation in the bonus round game with other players.

Sweeping changes permeate the gaming industry, from modernizing gaming systems to increase visibility and attractiveness to players to fine tuning player clubs that provide valued players with rewards. One focus of these changes includes provision for new and interesting methods of rewarding players to visit gambling locations.

One of the driving forces in changes in the gaming industry has been the effort associated with the modernization of gaming computer systems. This modernization of gaming machine themselves provides large amount of computing power and numerous peripheral systems that are typically under-utilized.

SUMMARY

It is realized that the dual forces of modernized gaming systems with underutilized computing power and peripherals, and the need for inventive reward systems to provide to players can be united to provide a new avenue of reward styled gaming. A current trend in the industry is to incorporate additional displays into gaming systems (typically LCDs), and in particular slot machine and video implemented games (video poker, etc). The first uses of LCDs in conjunction with gaming system provided small form factor displays with little or almost no functionality beyond a reward balance display. These LCD displays however, have become increasing larger and full featured, but typically are still being used just to provide functional information.

The incorporation of two way networks into gaming machines further facilitates use of a conventional gaming machine to new purposes. One should appreciate that taking advantage of the size and functionality of the LCDs already incorporated, and two way communication on the gaming machine, provides a new gaming vehicle with many advantages. In particular, real-time opportunities to provide player incentives through invitation are presented. Moreover the LCD display itself (or any other display associated with a gamine machine) may be used to encourage increased gaming activity by any particular player, or even groups of players. Such displays may include the use of picture within picture technology.

Encouragement may come in the form a win proximity meter, for example. Letting players know of winning events close by gives the individual player a sense that they too may also be close to a winning event and increase the sense of anticipation and investment in a particular gaming machine.

According to one aspect, a method is disclosed for providing additional incentives for a player to visit a gambling location (e.g., a land-based casino or other gaming establishment) and to increase play once there. In one example, a player participating in a frequent player program is provided an invitation to a multiplayer game to encourage the player to return to the casino or other establishment. In another example, the player participating in a frequent player program is provided an invitation while at the gambling location. The invitation may be delivered in response to play of a game at the gambling location. In one alternative embodiment, a player does not have to be a member of a frequent player's club to receive an invitation to a multiplayer game, rather the player may receive an invitation in response to play of an on-line game, or an "uncarded" player may receive an invitation while gambling at a gambling location.

The multiplayer incentive game may be funded separately from any game at which an invitation to play is delivered. In other words, the funding for the multiplayer game is derived from a different source that the wagers being placed on an underlying game, as is conventionally done in a progressive type jackpot award. According to one aspect, the multiplayer game is conducted on a large scale. In one embodiment, multiple gambling locations participate in the multiplayer game, and the multiplayer game has the capacity to accommodate every player at the multiple locations (assuming they are invited). In one embodiment, large scale is intended to cover the next cardinality of gaming, in other words, a multiplayer game can be thought of as a table game in a casino, which provides for multiplayer play, but are limited to the real estate at the table, thus these types of game approach a limit somewhere around 8-12 players, a large scale game would include a multiplier over and above the 8-12 players. In another embodiment, the multiplayer game is intended to measure participation in the thousands, and in another, in the tens of thousands, other embodiments include larger player populations.

According to one aspect, a massively multiplayer game (MMG) is provided by invitation only. Once an invitation is presented and redeemed, the game play of the MMG is displayed on a display screen associated with a gaming machine at a gambling location. In one embodiment, the funding for the massively multiplayer game is provided separately from the games played—and/or the gaming machines on which a player may qualify to receive an invitation. In one example, the massively multiplayer game takes the form of a bingo styled game. The parameters for the massively multiplayer game can be set and announced in advance, or the parameters for the MMG can be announced at the time of invitation redemption. Further, the parameters can be determined dynamically. In one example, a MMG comprises a bingo styled game played for an award of a predetermined jackpot. In one example, the bingo styled game is executed at predetermined times over a stated period. In one example a $10K jackpot will be determined every hour, in another every 30 minutes. One should appreciate that the frequency and the amount of the jackpot can be variable. Games can be initiated as often as minutes or seconds or any other time period.

According to one aspect, establishing a regular frequency for multiplayer games provides additional incentive to players. With an established frequency for conducting multiplayer games, players may appreciate that qualification is ongoing and not meeting criteria for one particular multiplayer game doesn't affect the possibility of meeting the qualification for the next. Indeed the knowledge that another multiplayer game is scheduled to take place in a short time may prompt a player to continue playing where s/he would have otherwise stopped. Further, awareness of another game, may also prompt increased play. In one example, a player who just missed qualification may be incented to satisfy the requirements for the next qualification period.

In one embodiment, it is important to establish for potential players in a MMG that a winner from the participants will be determined at each execution regardless of the number of entrants. Various embodiments of the MMG can be driven off of a number of games including for example, a bingo game, a tournament game, and a sweepstakes. One should appreciate that similar styled games are suited for use in the present invention. Tournament games can include for example, blackjack tournaments, where the best of a hundred black jack hands wins the associated jackpot, best-of tournaments can be adapted to cover almost any wagering game. In some embodiments, MMG can include rake-type games (as discussed in greater detail herein).

In one embodiment, a bingo style game is provided via displays incorporated into gaming machines. The bingo style game is separately funded from the underlying game or games being played on the gaming machine. According to some embodiments, the bingo style game is provided separately from the base game played by the player on the gaming machine. Jackpots awarded are not limited to any portion of the credits wagered on the underlying games and the game itself is separate from any underlying base game provided, according to some embodiments. Moreover, it is realized that providing separate funding sources for the bingo style games provides a number of advantages. In one example, a number of bingo styled games can be guaranteed to be played at guaranteed times. Thus a participant is able to know in advance that a game will be played and a winner will be determined. This is unlike progressive style jackpots in that the progressive style jackpot is funded through the underlying games, and the jackpot grows by participants not winning. According to one embodiment, each game has its own defined pool of players that compete against each other to win the jackpot. In some embodiments, more than one winner is permitted, in such embodiments each winner may receive a stated prize or share the overall prize.

One should appreciate that according to some embodiments, such bingo styled games are conducted separately from the underlying base game provided on the gaming machine and in particular are not conducted according to the typical constraints of Class II slot machine games. Known Class II slot machine games typically involve the entry of at least one player into a bingo style game upon initiation of a spin on the slot machine game, a winner if any is determined and the player would need to claim any win via the slot machine on which they play.

According to one embodiment, once an invitation is delivered, the incentive to go to a gambling location to enter the bingo styled game may be enhanced by the knowledge that at least one participant will win for any given drawing. These invitations may be delivered by mail or through displays incorporated into gaming machines, although other communication vehicles are contemplated (cell phone, e-mail, text, in hand delivery, pop-up and pop-under windows, etc.). Typically, a player qualifies to receive an invitation by meeting a game related threshold. Although in some embodiments, new players may also be given an invitation unrelated to gaming activity that can be used to enter a bingo style game. These invitations may be mailed on entry into a players club, or upon submission of player information for entry into a massively multiplayer game (MMG). Play of an on-line game may also trigger an invitation to a MMG. Typically an invitation is linked to play of another game, and in order to participate in the MMG, the invited player may be required to meet a threshold associated with game play. In one example, the invitation indicates that a player will be entered into the MMG if the player redeems the invitation at a specific gambling location. The invitation may require that the invitation be redeemed at a certain time. Other requirements may also be used, for example, a player may be required to maintain qualification for the MMG after receiving an invitation. Maintaining qualification may include playing a predetermined game for a predetermined time, or simply playing a predetermined game at a specific time.

According to another aspect, the multiplayer game may require a large number of participants. Although multiplayer games where awards are tied to the underlying game are known, massively multiplayer wagering games of chance has received little attention. Some known games include bonus round games in which multiple players are permitted to participate in the bonus round, however, such known games typically link the base game and the bonus game, and are limited in the type and size of the games provided.

It is realized in making the player pool massive, per player costs for jackpot awards can be reduced to nominal levels. In a separately funded game, per player cost impacts the size and frequency of winning awards. In one embodiment, a massively multiplayer game envisions the participation of players on a multi-gambling location scale, and further can be increased to include populations from multiple gambling locations. In one example, the well-known operator Harrahs operates over 50 gambling locations each with massive gaming populations. An embodiment provides for entry of players from over 50 gambling locations, making the invitation game truly massively multiplayer.

In one embodiment, the funding for the massively multiplayer game is provided separately from the games played—and/or gaming machines on which a player may qualify to receive an invitation. In one example, the massively multiplayer game takes the form of a bingo styled game. The parameters for the massively multiplayer game (MMG) can be set and announced in advance, or the parameters for the MMG can be announced at the time of invitation redemption. Further, the parameters can be determined dynamically. In one example, a MMG comprises a bingo styled game played for an award of a predetermined jackpot. The bingo styled game is executed at predetermined times over a stated period. In one example a $10K jackpot will be determined every hour, in another every 30 minutes. One should appreciate that the frequency and the amount of the jackpot can be variable. In one embodiment, it is important to establish for potential players in such a MMG that a winner from the participants will be determined at each execution regardless of the number of entrants.

In an alternative embodiment, it is recognized that there does not need to be a winner for each execution of the multiplayer game. In one example, the award of a jackpot prize may be linked to a specific event in the multiplayer game. In a bingo styled multiplayer game the event is achieving a bingo, and if no one achieves a bingo in the multiplayer game, the jackpot may roll over into the next multiplayer game. In one embodiment, the number of called balls in the bingo game is limited and where no one achieves a bingo, the jackpot rolls over into the next multiplayer game. In some other embodiments, the number of calls is not limited and game play progresses until a winner is determined.

Stated jackpot awards may vary according to player status and may also vary according to gaming qualification. In one embodiment, jackpot awards in the multiplayer game are customized for the player based on that player's status. In one example, player status relates to previous play by a player a gambling location. In another example, player status is based on achieved levels in a frequent players club. Player club level may be designated in a number of ways, and in one particular example, a gold player is invited to a $1K jackpot multiplayer game, and a diamond player is invited to a $5K jackpot multiplayer game, and a platinum player is invited to a $10K jackpot multiplayer game, each potential jackpot being related, at least in part, to the player club level to which the player belongs. One should appreciated that the designation of the levels themselves is unimportant, but the levels for a particular player are indicative of a value associated with a player. Value may be based on level of game play or other factors. Previous game play may also be used for "uncarded" players where unique identifiers and/or biometric systems are available for tracking that players activity.

According to another aspect, a player may be encouraged to play more, and/or play faster by displaying potential for invitation rewards through a LCD display associated with a gaming machine. Displaying, for example, a current rate of play to a player and a rate of play that would qualify a player to earn an invitation into a separate game lets the individual player know how many games s/he needs to play in order to qualify. Displays may also include picture-in-picture displays on gaming machines.

Invitation rewards for players may come in many forms. One known form of rewarding/providing an incentive to a player is a conventional mystery jackpot. A typical mystery jackpot uses a random number generator (RNG) to randomly select a number within a predefined range. In one example, the range may be from 1 to 10,000. If for example, the RNG selects 7,500, a mystery jackpot is awarded on the $7500^{th}$ credit wagered for a particular group of gaming machines. Status displays used in conjunction with the award of such mystery jackpots made the award ripe for abuse. Knowledgeable players were able to track the award of the mystery jackpot, and with any foreknowledge of the ranges used, the knowledgeable player could take advantage of the award of the mystery jackpot to change the house advantage into a player advantage for a payout. When the status displays indicated that a mystery jackpot was approaching its upper bound, the likelihood of being awarded a mystery jackpot increases significantly. Knowledgeable players pounced on this opportunity, by occupying as many of the participating gaming machines as possible, including use of coercive means to get already seated players out of their seats.

A gaming operator can yield the benefits of mystery jackpot type awards and eliminate some the avenues for abuse by interposing an invitation requirement in order to qualify to play in a game where the jackpot is awarded. Also, the gaming operator can influence player activity by increasing the number of jackpots, their amount, and by providing qualification indicators relating to game play. For example, indicating that a player currently qualifies for an invitation into a $5K game, while at the same time indicating that increased play would qualify the player for a $10K invitation game provides incentive for a player to increase gaming activity. In another aspect, providing an invitation into a bonus game provides additional security for the bonusing game.

In one embodiment, instead of directly awarding a jackpot based off of a random selection within a predetermined range, a game operator establishes play related thresholds as a qualification for an invitation to enter into a game separate from an underlying gaming machine and its base game and in some embodiments, separate from any bonus game associated with the base game. In one embodiment, invitations are delivered via a display screen incorporated/attached to the gaming machine. The game provides for participation in a massively multiplayer game for awarding a mystery type jackpot. In one embodiment, such play related thresholds include rate of play, and in other embodiments also include other play related thresholds (e.g. games per hour, credit wagered, credits wagered over time, coin in per hour/minute, average play time, total play time, total lost, total won, average lost, average won, etc.). By qualifying and inviting a large number of players into the massively multiplayer game, a game operator can reduce the per player cost of the award to almost negligible levels, thus permitting not only larger awards, and increased player incentive, but also making an increased frequency of jackpot invitation/payouts feasible and economical while maintain large awards.

Player qualification may also be used to determine the jackpot game(s) on which a player receives an invitation. Larger awards may be tied to player club level, and in particular, player club levels associated with higher value players, may trigger invitations into larger jackpot bonus games, or bonus games that occur with an increased frequency.

In one example, a plurality of gaming machines is operatively connected to bonus game server through a communication network. The bonus game server may or may not receive player club information on the individual players. Information on game play is collected during the course of gaming by a particular a player. Where the information on game play indicates that a particular player has met a threshold for a bonus game invitation, the player receives an invitation delivered to the gaming machine on which s/he is playing. In one example, a gaming operator provides the bonus game operator information with respect to a target credits wagered threshold. The credits wagered threshold can be variable with respect to a period of time, or may be fixed in advance. A threshold that is variable over a time period, may be designed to increase player participation by a certain percentage, for example a player who plays at a rate of 20 credits per hour may receive a message indicating that if over the next 10 minutes: credits wagered equals 30 or more per hour, an invitation to a bonus game will be earned. Statistics may be tracked regarding which particular player is receptive to what form of incentive, i.e. what would it take to make player X play more, how much money, how many bonus type games, which may be then used for player specific bonus offers.

In a typical example, a bonus game operator sets a threshold in advance, for example, 20 credits wagered per hour earns an invitation to a jackpot game. Prizes in the jackpot game are variable over games, but are typically fixed for a particular game, allowing for ease of implementation and tracking. Additionally, multiple threshold levels may be associated with game play, and each threshold may trigger different jackpot games with different jackpot awards.

In one embodiment, a player with 20 credits wagered per hour may be invited to a $5K jackpot game, whereas a player with 40 credits wagered per hour may receive an invitation to $15K jackpot game.

Additionally, an invitation may be sent to a player with a declining number of credits wagered, as the decline in credits may be used as an indicator of a player about to walk away from a gaming machine. The invitation may indicate that if player maintains a certain level of play for a certain period of time s/he will be entered into a bonus game. The level of play threshold may be determined dynamically, as well as the size of the jackpot prize game the invitation to enter corresponds to. Typically the period of time will be based on the beginning of the next jackpot game session, but the period of time may be configurable as well.

The qualification for an invitation may involve tracking play over a number of games and gaming machines. For example, a carded player may meet and/or maintain qualification for a multiplayer game even while switching the game and/or gaming machine s/he plays. In one embodiment, this is accomplished using a frequent player card inserted at the various gaming machines, although play for a player who is uncarded can also be tracked where a unique identifier is available and/or biometric systems can be used to identify and track the player. According to one embodiment, invitation status is maintained across a number of games and/or gaming machines, so that a player may be able to log back into a multiplayer game in progress after leaving a particular gaming machine and beginning gaming at another.

For example, a player received an invitation linked to a play incentive to wager 30 credits an hour, and the next multiplayer game is about to start, the invitation may require that the threshold be maintained for the next five minutes to qualify for the invitation. In one example, the display of the result of the jackpot game takes 5 minutes, so the player may be entered into a game in progress. Alternatively, the player is provided with a qualification requirement to receive an invitation and a requirement to maintain qualification. In such a case the invitation may display a requirement to maintain credit wagered levels over a period of time that includes that play of the multiplayer game.

Upon receiving an invitation, a player may be prompted to accept the invitation, on a display that is touch sensitive, or in another example, the invitation may simply indicate that continued play will be deemed acceptance. Some invitations set forth a time for the execution of the next bonus game, and may visibly display a count down to the bonus game. In some embodiments, the invitation conveys a qualification and maintenance requirement for the multiplayer game. Warning messages may occur in response to failing to meet the maintenance requirements. For example, a player may receive a message indicating: "You are about to be disqualified. Play 5 games in the next 3 minutes or you'll be withdrawn . . . ." Other messages can be used in conjunction with other maintenance criteria.

One example of a jackpot game includes a bingo game presentation in an LCD associated with a gaming machine. Such bingo games may be determined at the time of entry of all participating players, the display is done to give the appearance of a bingo game determinative of the outcome. Alternatively, each participant may be provided with an automatically generated bingo card that is automatically "daubed" on behalf of the player and the winner of the jackpot is determined through the play of bingo. Other multiplayer games are contemplated. One should realize that almost any game suitable for massive player participation is suitable for use in the present invention.

As discussed, an invitation prize may be redeemed on an operator's property (gambling location), thereby encouraging the player to return to the gambling location. In another example, the invitation is awarded after the player's experience on the operator's property, increasing the likelihood that the player will return to the operator's property to redeem the invitation. The invitation, in one embodiment, may include time period in which the invitation may be redeemed. The time period may be set so as to require a return visit. The time period may also require the visit occur within a certain period of time, or at specific times, for example, off hours gambling times.

In one embodiment, the invitation may be for an entry into a sweepstakes. In another embodiment increased play of the player on the operator's property may provide for qualification in a next level sweepstakes with a larger jackpot award. Players may become qualified for sweepstakes with larger jackpots based on particular types of behavior, such as, for example, length of play on a particular device, amount of money spent within a period of time, or other parameter associated with types of game play that the operator wishes to encourage.

According to another aspect, a player (carded or not) is incentivized to return to a casino or other gambling location through the play of an online game. According to another aspect, the game may be an online game that provides one or more invitations to be redeemed at a gambling location. Each invitation may indicate the player has qualified to participate in a multiplayer game, which will award a stated prize.

According to one aspect, a player may be awarded an invitation at the conclusion of play of the online game. The player may be required to return to the casino or other gambling location to accept the invitation. In this way, the online game is used to incentivize players to return (or visit) the gambling location, maximizing the opportunity to increase revenues.

According to another aspect, an interface is provided for improved access to results of the multiplayer games executed at the gambling locations. For a carded player (one who participates in a frequent play club) the player may be provided a link from his/her player club account that details how many games the player qualified for, who the winner was, and may also include proximity indicators for the winner(s) of the multiplayer games.

According to another aspect, individual players may compete with each other for invitation to multiplayer games. In one example, a display on a gaming machine indicates to a player not only his status with respect to an invitation, but the status of other players as well. The indication of other player status(es) may also include an identifier for the other player(s). In such a way, players are spurred to increase play through the competition to earn an invitation. In one embodiment, players compete to earn the best invitation, for example, to a game with a $50K jackpot, whereas the second player is invited to a $20K jackpot game.

It is realized that player qualification may also be impacted by events occurring during play of an underlying game. For example, achieving a difficult result in an underlying game may increase the rate of qualification, or may automatically qualify a player, or may increase the qualification level of a participating player. In one example, difficult results include long odd results. In one embodiment, where a player is playing on a video poker gaming machine, the event may be linked to achieving a royal flush and/or four of a kind, both low odd events in a poker game. In one example, the event triggers an alteration in the play of the multiplayer game. The alteration in play includes a multiplier to the award received for winning the multiplayer game. In another embodiment, the event triggers sequences in the multiplayer game. For example, a player may have to play a number of games before a portion of the multiplayer game will proceed. In another embodiment, an event causes a player's qualification status to change.

According to one aspect of the present invention, a computer implemented method for providing a player incentive is provided. The method comprises providing an invitation to a player to enter a multiplayer game, determining a threshold associated with providing the invitation, determining a player satisfies the threshold, and displaying to the player a status of an entry into the multiplayer game at a gambling location, and determining a winning entry from a plurality of entries into the multiplayer game. According to one embodiment of the present invention, the act of displaying further comprises displaying the status of the entry in response to play of another game. According to another embodiment of the invention, the play of the another game occurs at a gambling location. According to another embodiment of the invention, the winner entry is determined independently of game play of the another game. According to another embodiment of the invention, displaying to the player a status of an entry into the multiplayer game includes an indication that the player is qualified to participate in the multiplayer game.

According to one embodiment of the present invention, the method further comprises an act of determining a requirement to maintain the entry status. According to another embodiment of the invention, the requirement is based, at least in part, on a player status. According to another embodiment of the invention, the player status indicates the player is a new player. According to another embodiment of the invention, the requirement is based, at least in part on gambling metrics. According to another embodiment of the invention, the gambling metrics are associated with the player and include at least one of time spent gambling, size of wager, number of wagers over time, average number of wagers over time, average size of wager, coin in, average coin in, player club status, money lost, money won, a number of trips to the gambling location, duration of a trip to the gambling location, and average duration of a trip to the gambling location. According to another embodiment of the invention, the method further comprises an act of determining a frequency for execution of the multiplayer game. According to another embodiment of the invention, the act of providing occurs in response to play of an online computer-based game.

According to one embodiment of the present invention, the act of providing occurs in response to play of a game at the gambling location. According to another embodiment of the invention, the method further comprises an act of determining a requirement for redeeming the invitation. According to another embodiment of the invention, the requirement comprises at least one of redeeming the invitation according to a time constraint, playing a game specified in the invitation according to a time constraint, redeeming an invitation at a specified location, playing a game at a specified location, redeeming an invitation at a specified location and according to a time constraint, and playing a game at a specified location and according to a time constraint. According to another embodiment of the invention, the method further comprises an act of determining the winning entry into the multiplayer game at the gambling location. According to another embodiment of the invention, the method further comprises an act of determining a plurality of qualified entries into the multiplayer game.

According to one embodiment of the present invention, the act determining a winning entry from a plurality of entries into the multiplayer game occurs in response to determining the plurality of qualified entries. According to another embodiment of the invention, the act of determining a plurality of qualified entries into the multiplayer game includes a determination that the player met a requirement to maintain the entry status. According to another embodiment of the invention, the method further comprises an act of displaying to the player the status of the entry into the multiplayer game in substantially real time. According to another embodiment of the invention, the method further comprises acts of updating the entry status, and displaying the entry status in response to updating. According to another embodiment of the invention, the method further comprises an act of updating the entry status until the act of determining the winning entry from the plurality of entries into the multiplayer game occurs. According to another embodiment of the invention, the method further comprises an act of disqualifying the player based on the updating of the status of the entry. According to another embodiment of the invention, the method further comprises acts of determining a plurality of qualified entries into the multiplayer game, and updating the entry status until the act of determining the plurality of qualified entries occurs.

According to one embodiment of the present invention, the method further comprises an act of displaying a message associated with the status of the entry to the player. According to another embodiment of the invention, the message includes an indication that the player is close to qualifying for the multiplayer game. According to another embodiment of the invention, the message includes an indication that the player is close to losing qualification for the multiplayer game. According to another embodiment of the invention, the message includes an indication of how the player may maintain the status of the entry for the multiplayer game. According to another embodiment of the invention, the message includes an indication of an opportunity to qualify for another multiplayer game. According to another embodiment of the invention, the multiplayer game is funded separately from the another game. According to another embodiment of the invention, the multiplayer game is funded independently from player contribution to the another game.

According to one embodiment of the present invention, the multiplayer game includes a large number of entries. According to another embodiment of the invention, the act of providing the invitation occurs across a large population of players for each multiplayer game. According to another embodiment of the invention, a number of invitation exceeds a maximum number of players associated with conventional casino table based games. According to another embodiment of the invention, a number of players participating in each multiplayer game is at least on the order of a number of players participating in a progressive type game. According to another embodiment of the invention, the method further comprises determining a time to start the multiplayer game, and determining a time to end the multiplayer game. According to another embodiment of the invention, the act of determining a winning entry from a plurality of entries into the multiplayer game occurs at the designated time.

BRIEF DESCRIPTION OF THE DRAWINGS

The accompanying drawings are not intended to be drawn to scale. In the drawings, each identical or nearly identical component that is shown in various figures is represented by a like numeral. For the purpose of clarity, not every component may be labeled in every drawing. In the drawings.

DETAILED DESCRIPTION

Figure 1:
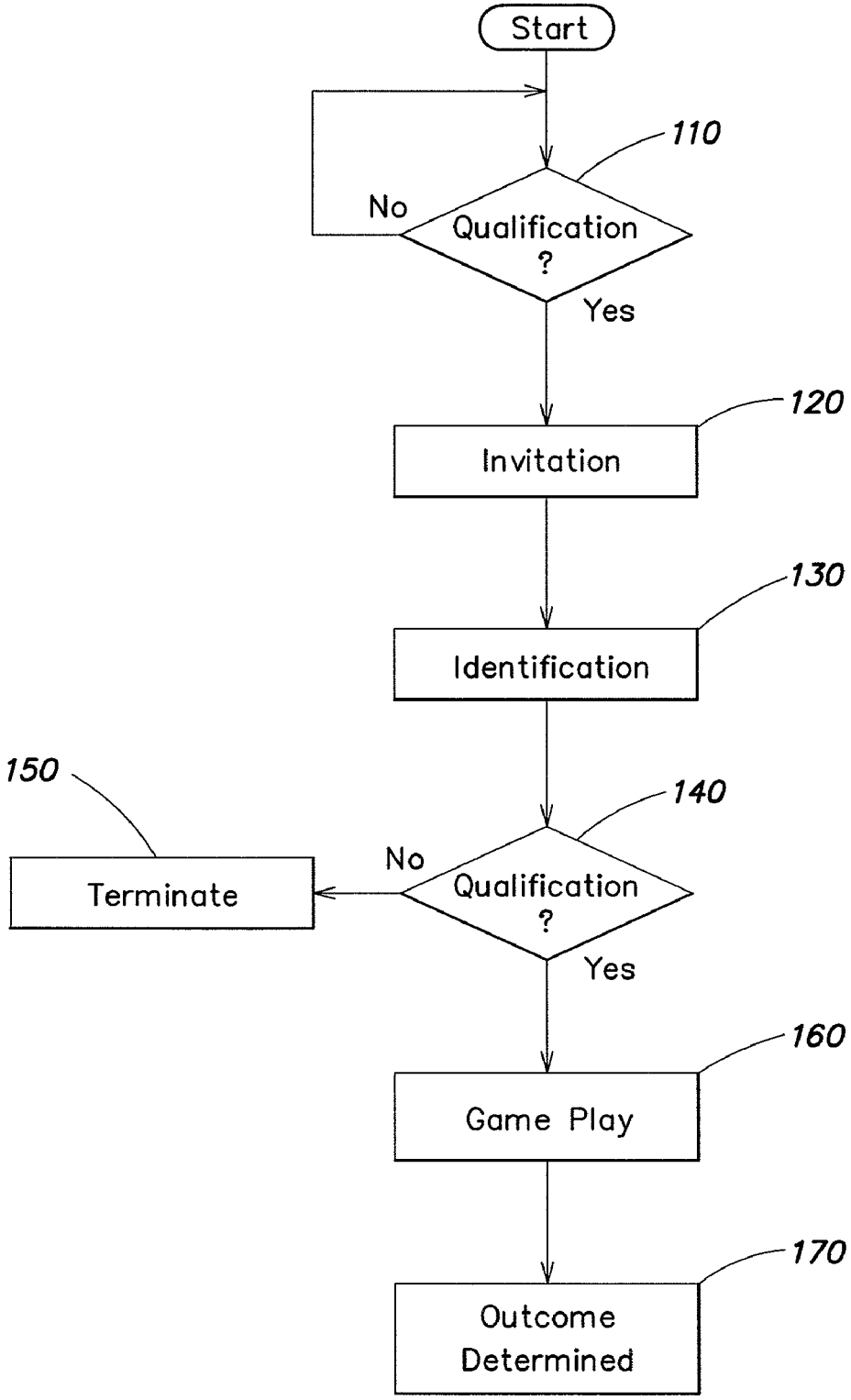
FIG. 1 shows a process for providing player incentive according to one embodiment of the present invention.

One aspect of the present invention relates generally to inviting qualified people to play in a multiplayer game with a stated jackpot award. Invitations are earned by an entity, usually a person (referred to as a player) that takes an action, for example, in at least one specified gambling location or affiliated location. Although an entity may also be a group of players, and in one embodiment, it is the group as a whole that must take a particular action, or meet a particular qualification in order to receive an invitation. In one example of a group embodiment, once the group meets the qualification, the entire group of players receives an invitation. Time limits may constrain when an invitation may be accepted, further time for the execution of the multiplayer game may also be temporally restrained. The invitation may detail a specified task that must be completed in order to maintain qualification to participate in the multiplayer game.

According to one embodiment, group participation may include defining a group as part of qualifying for a multiplayer game. In other embodiments, defining a group is not a pre-requisite, but may be used to facilitate group participation in a multiplayer game. In one example, a player identifies a list of participants in a group, creating a "buddy list." In another example, an invitation to a multiplayer game requires each member of the group to meet the qualification in order for the group to receive an invitation. In an alternative embodiment, the qualification of one member of the group qualifies the entire group for receipt of an invitation. As discussed further below, an interface may allow group member outside the casino to observer the progress of the multiplayer game, and in an embodiment that requires a player to maintain qualification the interface allows players offsite to remotely track the qualifying player's status. A group may be predefined, or may be dynamically generated. Common characteristics may be used to dynamically generate a group, random selection may also be used, and other features may facilitate group formation, for example, proximity, among others.

According to another aspect, an entity may qualify for an invitation through play of an online game that is offered over the Internet, for example. In another example qualification for an invitation may be related to gambling activity tracked through a frequent player club membership.

Another aspect relates to a qualified person for an invitation, where there is a determination of the qualification of that person. The term "qualified" as used herein indicates that a person or persons are placed, based on a variety of criteria, into specific categories and each qualified category may be eligible for a different multiplayer game, or combination of games, different outcomes, different likelihoods of reaching a given outcome, different award schedules, different visit requirements for redemption and/or different task completion requirements for redemption. For example, specific time limits may be imposed based upon player categories, game types, winning outcome redemptions, award size and task completion requirements.

According to one aspect, it is appreciated that qualification may be based, for instance, upon a person's participation in a particular game at a gaming location, participation in an online game, participation in a frequent player's club, answers to questions, the person's activity at a gambling location, length of visit to the gambling location, frequency of visits, average length of visit, games played, amount wagered, credits wagered over time, speed of play, coin in, average coin in or other criteria which relate to the person's instant condition, and may also include player status information. In one example, a person's status indicates that it is the player birthday, triggering an invitation to a multiplayer game. Alternatively, or in combination with instant qualification criteria, the person's record of information that was previously obtained and stored in association with the person's identification may be used to determine qualification.

Various qualification requirements can be established, for example, as discussed in U.S. patent application Ser. No. 11/780,882 entitled "METHOD AND APPARATUS FOR PROVIDING PLAYER INCENTIVES," filed on Jul. 20, 2007, incorporated herein by reference in its entirety.

According to another aspect, qualification for an invitation to a multiplayer game may not be the only requirement imposed before an award is determined in the multiplayer game. Once qualified for an invitation, a player may be required to perform additional actions in order to maintain an entry into the multiplayer game. The requirement to maintain an entry into the multiplayer game may also be based, for instance, upon a person's participation in a particular game at a gaming location, participation in an online game, participation in a frequent player's club, answers to questions, the person's activity at a gambling location, length of visit to the gambling location, frequency of visits, average length of visit, games played, amount wagered, credits wagered over time, speed of play, coin in, average coin in or other criteria which relate to the person's instant condition. Further, the requirement to maintain an entry status may be based upon taking an action, attending an event or visiting a gambling location on a particular date.

According to another aspect, the qualification for an invitation may depend at least in part, on a player taking an action within a gambling location (e.g., in a casino), or within an online gaming environment (e.g., over the Internet). In at least one instance, the action may involve the player using an identifier of a frequent player program. In one case, for example, the player may swipe his or her frequent player program card at a casino location, which causes the player to become qualified to receive an invitation to play in a multiplayer game. In another example, the player may "swipe" or otherwise enter their frequent player identifier in an online environment, causing the player to become qualified. To this end, various aspect of the invention may be facilitated using a frequent player tracking system.

In yet another example, a player may receive an invitation to play a multiplayer game during a new player promotion that may be conducted at the gambling location (e.g., at the casino). In one instance, a player may receive, as part of a new player promotion, an invitation to play in a multiplayer game when the player visits the gambling location. For example, the player may receive a brochure which includes an invitation that allows the player to enter a multiplayer game. The invitation may be associated with a unique identifier, for example a bar code, when received at the gambling location, may permit tracking of the player for awarding an prize earned in the multiplayer game. Further the unique identifier allows the gaming location to track compliance with any additional requirements for maintaining eligibility in the multiplayer game, even for players who do not participate in a frequent player club.

Another action that may cause a player to receive an invitation may include a player referring a "friend" who should receive an invitation. The referral of a friend may also qualify the referring player for the same or another multiplayer game. Such a program may be beneficial in identifying potential gamblers, as a personal reference, who is likely to accept an invitation and redeem it at a gambling location. Identifying an additional player who may be more likely to accept the invitation rather than a mass mailing to a particular group of people maintains a qualification level and provides a more likely target market. In this way, an action by a current player may cause an invitation to be extended to another player, and may at the same time earn an invitation to the same or a different multiplayer game session for the referring player. According to one embodiment, the invitation includes a unique identifier.

The term "identifier" as used herein indicates a device, code or technique used to recognize a particular person. The identifier may simply be a number or code associated with the person, such as a magnetic stripe card or a smart card which contains electronic or other circuitry. The identifier may also be biometric, such as voice-print, handwriting recognition, fingerprint, hand shape recognition or eye-pattern recognition. It should be appreciated that there are many different ways to identify a person uniquely, or as a member of a group, and all such techniques are anticipated as being useful for implementing various aspects of the present invention.

The term "invitation" as used herein refers to a request extended to a qualifying person to participate. Examples range from a printed invitation to a website offering a place to play a game or take some other action. Invitations may be communicated by any means, including but not limited to, electronic, written and verbal means. It should be appreciated that there is a wide range of ways to invite a person uniquely, or as a member of a group, and any such way of inviting a person may be used.

The term "specified time period" as used herein indicates a period before or after a specific time and date or a period within a beginning and ending time and date. A specified time period may be unbounded as in "any" time or may be more limited. The term may, for example, include a recurring time period, such as every Wednesday, every Tuesday afternoon between the hours of 2 and 5 PM, the last Monday of each month, every Fourth of July, this coming Fourth of July, amongst others. The term may also be construed as any type of time period that can be specified by one or more parameters. It should be appreciated that there are many other permutations and combinations of onetime and recurring time restrictions that can be useful in various embodiments and representation of all such permutations and combinations is intended by the term "specified time period" and its variants.

The term "gambling location" as used herein refers to any location where free or fee-based gambling is allowed. Examples of gambling locations include, but are not limited to, casinos, racinos, dog-racing tracks, horse racing tracks, sports books, lottery point-of sale locations, clubs or pubs where gambling is conducted, amongst others Gambling locations may be at physical locations such as the land based casinos in Las Vegas, a range of locations, such as "any land based casino in the United States, or a virtual location such as an Internet-based gambling site. It should be appreciated that there are many possible types of gambling location and all such locations are contemplated for use in various embodiments.

The term "affiliated location" as used herein refers to any location that is not a gambling location. Affiliated locations are places identified by gambling locations or their representatives at which a person may receive an invitation, qualify to receive an invitation, when invitation or qualification does not involve any element of gambling. The term "redemption location" as used herein refers to the location, which may be either a gambling location, where an invitation may be accepted to participate in a multiplayer game.

One embodiment of the invention is implemented as a process including acts of qualification, invitation, identification, and action, as represented in FIG. 1. Step 110 includes an act of determining if a player meets a qualification, if the player does not meet the qualification initially, qualification is rechecked 110(NO). Step 120 is invitation, wherein a person is invited to participate in a multiplayer game. Step 130 is identification, where the person's identity is ascertained when the player accepts an invitation. Step 140 includes an optional test of qualification maintenance, wherein the person is measured against a predefined requirement to determine if they are have properly maintained their eligibility to participate in the multiplayer game. If the person looses their qualification, the player can not receive an award in the multiplayer game, and the process terminates at step 150. Optionally (not shown) the qualification system displays a message to a player regarding qualification. In one example, the message indicates that the player is close to losing qualification. In another embodiment the message may indicate the steps necessary to maintain qualification. In one alternative, the message indicates to a player that they are close to qualifying for another multiplayer game with, for example, a larger prize award. In another embodiment, a "health meter" is displayed during the course of game play. In one embodiment, the display meter indicates an amount of credits wagered (see e.g. FIG. 6 "display meter").

Figure 6:
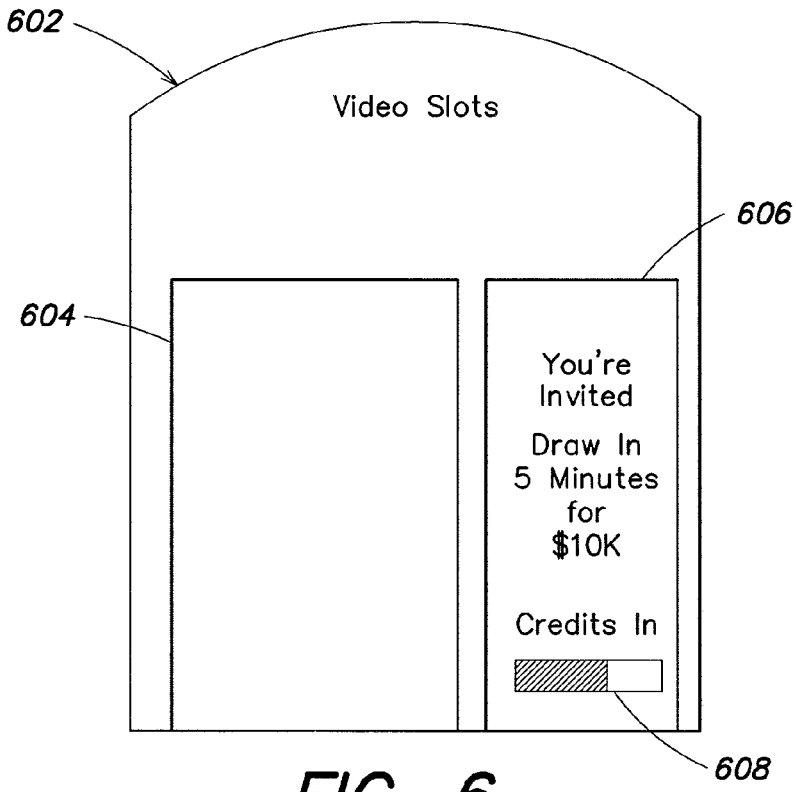
FIG. 6 shows an example of a display on a gaming machine according to one embodiment of the present invention.

Shown in FIG. 6 is an example of a display one a gaming machine for displaying a multiplayer game according to one embodiment. The gaming machine 602, includes a game display 604, for rendering the game experience to a player. For gaming machine 602, the game comprises a video slot game. In conjunction with the game display 604, another display 606 is integrated into gaming machine 602. Display 606 provides messages to the player on gaming machine 602, indicating that the player is invited to participate in a multiplayer game. Display 606 includes a meter reflecting "credit in" on the gaming machine 602, at 608. Meter 608 can provide visual indication to the player of qualification status for the multiplayer game.

Figure 7:
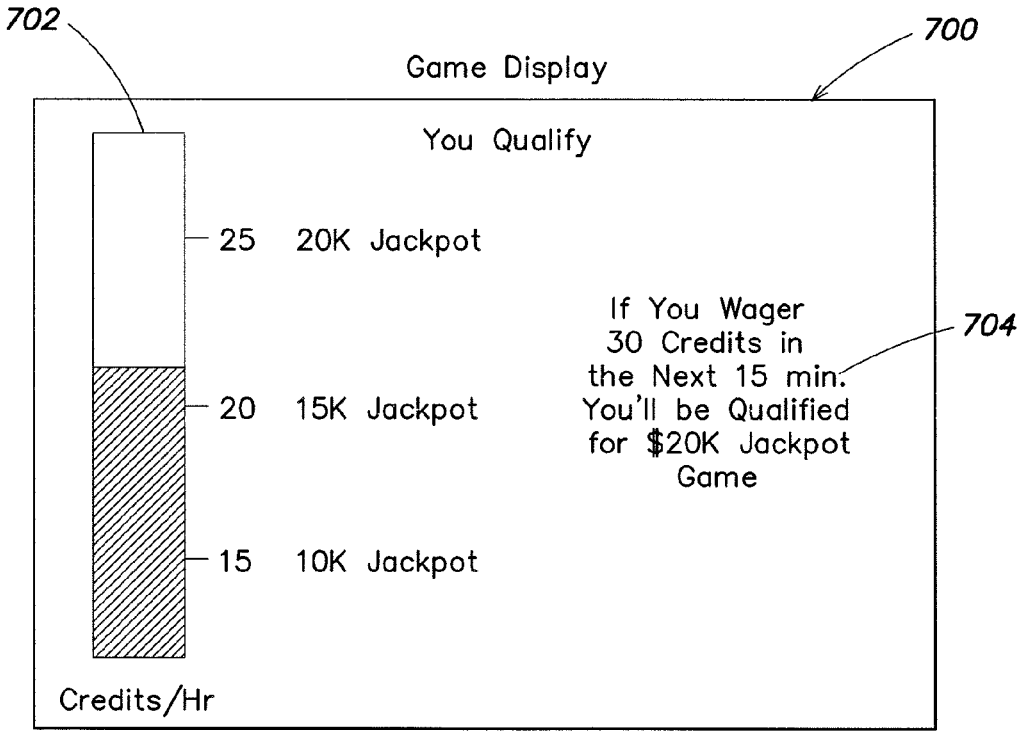
FIG. 7 shows an example of a display according to one embodiment of the present invention.

In another example, (see FIG. 7) the meter may indicate credits per hour. According to various embodiments, the display meter is configured to display information associated with the qualification for an invitation to a multiplayer game and/or the maintenance of the qualification of a player in the multiplayer game. In one example, where the qualification is based on credits wagered over time, the display meter indicates the number of credits wagered over that period of time, at 702. The color used to display the meter may change as a player is close to achieving the qualification, meets qualification, and/or exceeds qualification. Audio cues may also be used to indicate a player is close to achieving the qualification, meets qualification, and/or exceeds qualification. In one embodiment, a message is provided to a player indicating an opportunity to qualify for game with a larger jackpot, for example, at 704, to encourage increased frequency of play, for example.

In one embodiment, a health meter may indicate if, and how well, the player is satisfying the requirements for qualification. The health meter may alter visibly in response to a player being close to losing qualification, alteration may include change in display size, flashing, change in color, flashes of color, among other visual cues. Additionally the entire display may be altered to bring a player's attention to the possibility of losing qualification. Alternatively, in one embodiment the display is altered to indicate the achievement of qualification, for example.

At step 160 qualified persons are identified (and optionally identifying those players that maintained their entry status) and the multiplayer game is executed for the qualified players. One should appreciate that steps 110-140 may occur at the same time or in opposite order. For example, the multiplayer game may begin for players who are qualified at that time and players may be eliminated for failing to maintain eligibility to participate during the course of the multiplayer game. At step 170 the outcome, i.e. the winner of the multiplayer game is determined.

While FIG. 1 shows at least one example of the present invention which represents the steps of qualification, invitation, identification, and play as occurring in a specific order, it should be appreciated that the order of these steps may be altered and remain within the scope and spirit of the present invention.

Qualification

In one example qualification comprises play of an online game in an environment outside a gambling location. According to one aspect, identifying players who are likely to accept an invitation to a multiplayer game conducted at a gambling location is valuable not only to the gambling location but for the party/operator who refers such players to the gambling location. It is realized that there is a reluctance on the part of players to visit a gambling location if they are not already inclined to do so. The invitation to participate in a multiplayer game serves to overcome that reluctance, according to some embodiments.

Different criteria may be employed to identify such players who are likely to accept and redeem an invitation. In one embodiment, the different criteria are used to qualify players to receive an invitation. In one example, qualification relates to the amount of play of an online game. For example, a player who plays a minimum number of hours over a predetermined time period, receives an invitation that may be accepted at a gambling location. The invitation may include requirements that must be met in order to accept/redeem the invitation. In one particular example, the requirements include accepting the invitation by visiting a gambling location within a specified period of time. In another example, the requirement includes accepting the invitation by visiting a gambling location at a specified time, or time period.

In another example, qualification for receiving an invitation may be triggered in response to a certain number of wins, a certain number of losses, or a certain number of games played online. One should appreciate that almost any statistic associated with game play of the online game could be used to trigger an invitation. Moreover, qualification may be independent of game play. For example, player status may be used to determined qualification. A player who plays a lot may achieve a preferred status with respect to the online gaming environment. In one example, achievement of a preferred status is used as qualification for an invitation, and upon achieving preferred status an invitation is sent to the player. One should appreciate that achieving a preferred status may be accomplished in an number of ways. In one example, a preferred status may be earned by completing events in association with the online player's account and in another, by earning points from game play. Referring friends earns preferred status in another example. Other player status qualifications include being a new player, first time player, or a player who plays infrequently, as some examples.

In another embodiment qualification may include playing a game in a gambling location. In one example a player is a member of a frequent player's club. Although a player does not have to be member of a player's club to receive or qualify for an invitation, some aspects are facilitated by membership.

A player, having inserted a frequent player card into a gaming machine may be tracked by a casino management system. In another example, a slot management system provides tracking functions. Tracking may include statistics on game play, for example, coin in per hour, number of wagers, amount of wager, credits wagered over time, average time of play, and may include other statistics not dependent on game play; average number of visits, average length of visit, and present length of visit as examples. Qualification to receive an in invitation to participate in a multiplayer game with a stated jackpot may be earned with respect to the tracked statistics. In one example, a video poker player has her frequent player card inserted in a video poker gaming machine. During play, the players' statistics are reported to a casino management system, which may include a slot management system, or a the frequent player club system. Players' statistics may also be reported to a separate or integrated qualification system. In one example, a qualification system has predefined qualifications for issuing an invitation to a player. In one example, the qualification comprises a certain number of credits wagered per hour. In one embodiment, in response to a player meeting the qualification, the qualification system communicates an invitation to the player, which the player may accept, thereby participating in a multiplayer game with a stated jackpot award.

Other qualifications related to game play are used in various embodiments, whether for online games or for gambling games. Different examples include, time of play, time of play per session (over day or month or year(s)), average time of play, coin in per time period, average coin in for a player over a time period, money lost, money won, time of play, length of play, average statistics, credits wagered, and average wager, etc. Qualification may also be related to player status or player activity. Some examples include trips to a gambling location, number of days at a gambling location, time spent at a gambling location, average duration of a trip, average number of trips to a gambling location, etc.

One should appreciate that any number of qualifications may be used that are associated with gambling activity, gaming activity, player status or any combination thereof. In response to qualification being determined, an invitation is communicated to the qualified player.

Invitation to Multiplayer Game

In another embodiment, a player plays an on-line game. In one example, the operator of the online game has a relationship with a gambling location, affiliated locations, or operates one of the same. The online game may take any form, skill, chance, wagering, free play, competitions for points, as examples. By tracking activity in the online gaming environment the online game operator identifies players who meet a qualification that may be provided by a gambling location, or affiliated location operator, or the qualification may be used by the online game operator to identify players of particular value to gambling locations, affiliated locations, or the like. In one example, the player participates in online card based tournaments, although any on-line gaming activity that may indicate a propensity or inclination to gambling activity may be tracked and form the basis for qualification for an invitation.

It is realized that keying an invitation to a multiplayer game to the underlying game on which the player qualification was determined is advantageous, according to some embodiments. For example, a player of online poker games would be more likely to act on an invitation to participate in a multiplayer game, where any stated requirement is related to play of a poker game. Indeed the multiplayer game may also be related to qualification. In one example, where the player qualified for an invitation through play of an online poker game, the invitation is for a multiplayer game that comprises a tournament style poker game. In another example, the multiplayer game may depend on the best of 100 hands of poker taking home a stated jackpot (although different numbers of hands may be used in other embodiments).

In another example, the invitation may provide for a requirement to play in a number of poker games at a gambling location or affiliated location to maintain the entry into the multiplayer game conducted at the gambling location or affiliated location. According to another embodiment, the multiplayer game may take place across gambling locations and affiliated locations. Requirements to maintain an entry in a multiplayer game may be similar to the qualification for an invitation to participate in the multiplayer game itself. In some examples, a requirement to maintain an entry comprises any of the qualification requirements discussed herein, or any combination thereof.

According to one aspect, a invitation state may be saved for later use. In other words a player may begin satisfying qualification requirement for entry into a multiplayer game, save the state of his entry, and complete the qualification requirement at a late time. In one example, a time limit is set for satisfying qualifications in progress. In another example, a player may begin play of a multiplayer game for which s/he has received an invitation and the state of the multiplayer game is saved for later use. A time limit may also be set for completing an in progress multiplayer game.

Once a player is determined to be qualified, an invitation is delivered to the qualified player. The invitation may be communicated via an online gaming environment, through an addressed email, via a cell phone, or any other electronic communication device. At a gambling location the invitation may be sent directly to a gaming machine at which a qualifying player is playing. In one example, an auxiliary display attached to the gaming machine displays an invitation to participate in a multiplayer game. The invitation may be accepted by the player simply by continuing play. In one alternative, where the display is touch sensitive, a player may indicate assent by selecting "yes" within the display, or the player may indicate the negative by selecting "no" within the display.

According to some embodiments, an invitation may include an explicit requirement to maintain an entry into the multiplayer game. In one example, an invitation indicates that the qualified player must maintain his/her entry status by continuing to play the game on which s/he qualified, for a specified period of time. In another example, the invitation may indicate that a certain rate of play is required to maintain entry status.

According to one embodiment, once the invitation is delivered, the invitation indicates that it must be redeemed at a gambling location participating in the multiplayer game. In one example, the invitation provides a specified time period for accepting the invitation.

According to one embodiment, the invitation states the amount of the jackpot that will be awarded in the multiplayer game. One should appreciate that according to some embodiments, the multiplayer game jackpot will be awarded regardless of the number of entries. Players understanding this requirement may be further incented to participate, as such players realize that reduced participation will increase the chances of winning the multiplayer jackpot.

Multiplayer Game

In one embodiment, the multiplayer game occurs across as many gambling locations and affiliated locations as permissible by gaming law. It is realized that the larger the player population, the greater the opportunity to incent players to visit gambling locations. It is realized that the greater the number of players translates directly into lower per player costs, and consequently larger potential prizes and increased frequency of multiplayer games with larger jackpot awards.

In one example, the multiplayer game is a bingo game conducted across a number of gambling locations. Bingo styled games are particularly suited for the multiplayer game, as it is realized that bingo styled games may be conducted over an almost unlimited player population. Typically all that is required to increase the player capacity for bingo styled games is additional tracking and communication hardware/software. As discussed above, increases in player population provide a number of advantages, according to some embodiments. Large populations of players can be dubbed "massive" player populations, and it is realized that the more massive the player population for the multiplayer game that can be accommodated the more incentive opportunities that may be presented. It is realized that conventional incentive games are limited in the size and scope of the player population who can participate, and according to various aspects discussed, massive player populations can be accommodated and benefits associated with such large populations can be achieved.

In one example, where an invitation details a requirement to maintain an entry status-the multiplayer game may begin for all qualified players, players who fail to maintain their entry status may become disqualified over the course of play of the multiplayer game. In one example, a video poker player qualified for an invitation to the multiplayer bingo game with a stated jackpot of $10K. The invitation indicated that the multiplayer game would begin in two minutes, and the player must maintain 20 credits wagered per hour for the duration of the multiplayer game to maintain her entry status. While the player is playing the video poker game, the multiplayer game is executed and displayed through a display on the video poker gaming machine. According to one embodiment, the execution of the multiplayer games occurs independently from the execution of the video poker game being played to maintain qualification. In another embodiment, whether the player wins or loses in the video poker is not a factor in the result of the multiplayer game.

Messages regarding the video poker player's status in the multiplayer game may be communicated during the course of the multiplayer game. For example where a player is about to lose their qualification a warning message may be displayed. In one example, a warning message indicates to the player that they are about to lose qualification, and must perform some action in association with the requirement to maintain their status. In another example, the action is play 5 games in the next minute to maintain status. In yet another example, the message indicates that the player needs to wager at least 10 credits in the next two minutes. Various messages may be tailored appropriate to the requirement provided to maintain entry status in the multiplayer game.

One should appreciate that for some embodiments of stated jackpot games, the prizes are awarded to at least one player in the multiplayer population regardless of the number of the qualified participants in the multiplayer game. In one example, if a small number of players actually accept invitation to participate in a multiplayer game for an award of any amount, the participating players may realize that they have an increased chance of winning the stated jackpot. In one embodiment, an interface is provided for tracking player participation in multiplayer games, accessible to potential players in the multiplayer game. In one example, the interface provides only historical information regarding multiplayer games already conducted. In another embodiment, the interface provides information about multiplayer games that are or will be conducted. The interface can be incorporated into an existing gaming machine that communicates to an incentive game server, typically separate from any base game server connected to the gaming machine for controlling play of the underlying base game and/or any bonus game associated with the underlying base game.

Other types of games are suitable for use as the multiplayer game according to various aspects. One example includes the use of tournament style games. In particular, a tournament style game may be a best of 100 hands of blackjack, in other embodiments, other card based games may be provided in a best of format. Such best of tournaments may provide for any number of hands.

In some embodiments of the multiplayer game, play in the underlying game may impact play in the multiplayer game beyond providing qualification requirements. In one embodiment, game play in an underlying game may be used to trigger play in the multiplayer game. In one particular example, a player must make 10 spins on a slot machine game to achieve a called ball in a bingo multiplayer game. After another 10 spins, another ball is called. In such an embodiment, a player may be incented to play faster as the quicker s/he receives calls in the bingo game the better that player's chance to achieve bingo, for example. In another embodiment, play of a slot machine game acts as a trigger for play of a blackjack multiplayer game, after 10 spins on the slot machine game, the player gets, for example, a hand of blackjack in the multiplayer game. In another example, 10 spins gets one card.

According to another aspect, play of the underlying game may also trigger additional rewards with respect to the multiplayer game. In one example, a player qualified for an invitation on a video poker game. During the course of the multiplayer game, the player continued play at the video poker machine and received a royal flush. Receiving the royal flush triggered an increase in the jackpot pot award. Increases may take the form of a multiplier and may include a pay table associated with odds of achieving particular events in the underlying game. The multipliers and/or pay tables may be stored in a database and retrieved before, during, or after play of the underlying game.

Other types of games are suitable for massive multiplayer incentive games. In particular rake-type games can be implemented in massive multiplayer format. Rake type games include multi-player games of skill and chance that have typically been limited to the space of a gaming table (and include various poker games, craps, roulette, etc). In traditional rake style games, a gaming operator typically takes a commission for organizing, staffing and hosting the game, often called the "rake." The rake can be a percentage of the pot, but can also include non-percentage methods for calculating the rake, including flat fee, per hour fee, etc.

According to some embodiments, electronic tables, and/or various display systems at traditional tables enable a network effect between players at the tables and players who are not, including players who are off property, players who are gaming at non-rake base games, players located at different gaming establishments, etc. Again increasing the size of the player population abile to participate increases benefits for the game operators as well as the players.

In one example, outcomes for a MMG can be pre-generated, for example, when a player makes a wager in a base game. In one example, pre-generated outcomes include generating values for dice rolls for a MMG dependent on dice rolls, in other examples millions and/or billions of hands of poker can be pre-generated to provide for outcome determination of a MMG. In some examples, pre-generated hands can be selected sequentially, among other options.

Examples of Implementations

Figure 2:
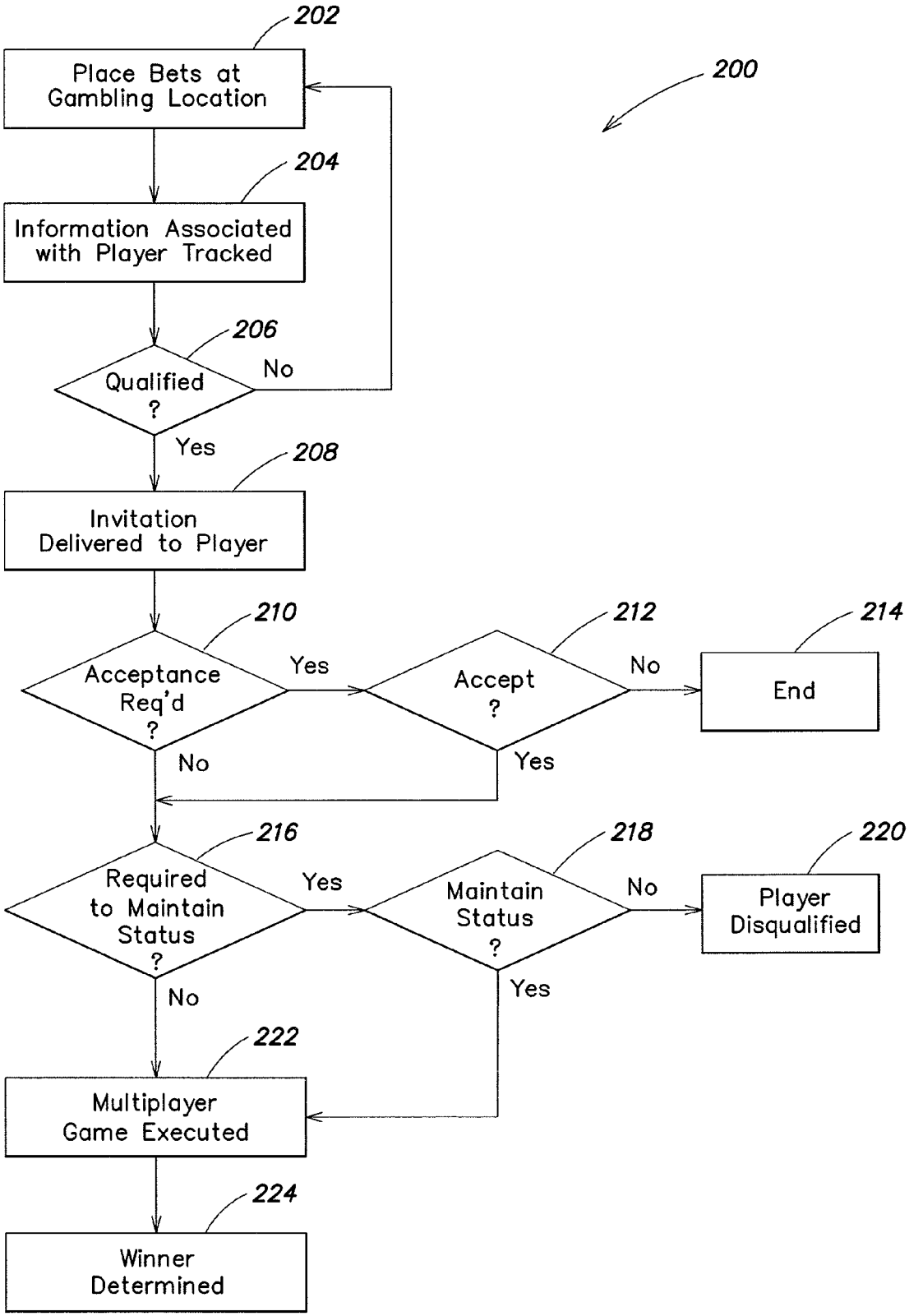
FIG. 2 shows a process for providing player incentive according to another embodiment of the present invention.

One embodiment of a multiplayer game includes the following features:

- A Massively multiplayer game refers to the ability to have an essentially an unbounded number of participants in the game although smaller numbers are permitted
- Reducing the per player cost by increasing the number of players
- Leverages massive numbers of players into large pre-stated jackpots that represent miniscule per player cost to a game operator
- Minimal cost per player also means increased number of potential jackpot games
- Networked implementations across gambling locations also leverage massive numbers to generate even lower per player costs Messaging to a player participating in a multiplayer game may include:

- Conditional invitations: "You may qualify for 25K Jackpot if you perform an action"
  - One example: Coin in exceeds 25 coins per time period
  - Another example: 10 Credits wagered in 10 minutes
  - You play five games in next time period
- In an example game that requires maintenance of qualification during the operation, messages may include for example:
- Warning messages during course of play of Jackpot game "You're about to loose your qualification"
  - You need to wager 25 coins in 5 minutes to stay in Another embodiment of an invitational jackpot game includes the following features:

- Invitational game presented on an LCD display attached to a gaming machine (in one example a slot machine game)
- The multiplayer game is a bingo game presented to a player playing the underlying slot machine game
- The player having reached a predetermined credits wagered threshold in the slot machine game receives a message over the LCD screen attached to his gaming system.
  - The LCD may be touch sensitive and ask the player to actively select to participate or in another example presents a notification of an invitation to the next scheduled game that needs no further action
  - Another example may invite a player to maintain current level of player for (short period of time) to be invited into jackpot game
  - Where the next scheduled game is in (a short period of time—typically 5 to 10 minutes) the player has increased incentive to continue gaming and may also have incentive to continue gaming at the threshold level, additionally the invitation may be crafted to spur increased play to achieve the invitation
  - Alternatively, the multiplayer game may be displayed within a display of the gaming machine as a picture-in-picture display With reference to FIG. 2, shown is an example of a process flow according to some aspects of the present invention. Process 200, illustrates one example flow for providing an incentive to a player in the form of a multiplayer jackpot game. At step 202, a players places bet(s) at a gambling location. For a player in a frequent player club, i.e. a "carded player", information associated with the player is tracked at 204, via the player "swiping" their player card. For example, a player playing a video slot gaming machine may insert a magnetic player's club card into a card reader on the gaming machine. One should appreciate that "uncarded" players may also participate in process 200. For example, game play statistics may be tracked on a per gaming machine basis, thus at least some information associated with even an uncarded player is tracked at step 204. Determining the beginning and end of gaming for such uncarded players does present challenges, in one example, a timer is used to identify the beginning and/or end of a gaming session for a particular player. Alternatively biometric devices may be employed to identify a player, and track information associated with the player. In another alternative, an uncarded player is given a unique identifier that functions similarly to a player's club card to allow tracking.

Information associated with the player is used to determine if the player is qualified to receive an invitation into the multiplayer game. At step 206(YES) a player is determined to qualify for an invitation. For example, the player qualified to participate in a $10K multiplayer game by wagering 10 credits in 10 minutes. In another example, the player qualified by wagering 50 credits in 10 minutes. In yet another example, a player qualifies for an invitation by playing an identified game. One should appreciate that various criteria may be applied to the qualification determination. According to one embodiment, qualification is determined against a predefined threshold, where the predefined threshold is established by the operator of the gambling location. In another embodiment, the predefined threshold is established by an operator of the multiplayer game. The predefined threshold may be defined in association with game play statistics, for example, number of games played, number of different games played, play on a specific game, amount of play on games played, duration of play, average wager, average wager over a specified time period, average wager per game, maximum wager, minimum wager, and other statistics that may be derived from tracked information. In another embodiment, the predefined threshold is defined in association with information on player status, for example, a frequent player club status, a preferred status, a new player status, an old player status, and inactive player status, and may include date of birth, among others. At step 206(NO), a player is determined to not meet the qualification for an invitation, however, that player's activity will be continued to be tracked an analyzed to determine if the player may later meet qualification, at steps 202-206.

At step 208, an invitation is delivered to a player. In one example a player at a video slot machine game, receives an invitation as a display in an auxiliary display associated with the gaming machine. Although other delivery methods may be used to display an invitation at a gaming machine, including a picture-in-picture display. Alternatively, invitations may be communicated separately from the gaming machines on which a player qualifies. For example, a carded player may identify alternative communication vehicles, for example, e-mail address, cell phone number, text id, pager, among others. One should appreciate that the more immediate the method of communication the more suitable it is for delivery of invitations according to one aspect of the present invention. According to one example, an invitation indicates a time for beginning a multiplayer game. Other information may be delivered in association with the invitation. For example, the invitation may indicate a requirement to maintain an entry status, a frequency on which the multiplayer game will be executed, the amount of the jackpot associated with the multiplayer game, a number of prizes in the multiplayer game, among others. In one example, the invitation indicates that acceptance is required by the player.

If acceptance by the player is required 210 (YES) a player accepts the invitation at step 212(YES). In one example, acceptance takes the form of continued play on a gaming machine, in another example, the invitation may be displayed on a touch sensitive display, and the player selects an affirmative option to indicate acceptance. In another alternative, acceptance is the default and only by taking an action may a player not accept the invitation. If a player does not accept 212(NO), participation in process 200, ends at step 214 for that player.

In embodiments where acceptance is not required, 210 (NO), and where a player has accepted the invitation 212 (YES), process 200, continues at step 216. If a player is required to maintain their status to participate in the multiplayer game, 216(YES), a player must maintain their status 218(YES) in order to be eligible to win a prize in the multiplayer game. Typically, players maintain their entry status in a fashion similar to qualifying for the multiplayer game. In one embodiment a requirement for maintaining entry status is defined in association with game play statistics: number of games played, number of different games played, play on a specific game, amount of play on games played, duration of play, average wager, average wager over a specified time period, average wager per game, maximum wager, minimum wager, and other statistics that may be derived from tracked information, as examples.

In another embodiment, a requirement is defined in association with information on player status, for example, a frequent player club status, a preferred status, a new player status, an old player status, and inactive player status, among others. To illustrate, a player who qualified to participate in the multiplayer game at 206(YES) by wagering 15 credits in 10 minutes, may have a similar requirement to maintain their entry status in the multiplayer game. For example, the player must continue to wager at the same average frequency in order to maintain their status. Alternatively, a lower requirement may be used (10 credits over 10 minutes) to maintain status, and in another alternative, an increased requirement may be employed (20 credits over 10 minutes). In another example, the requirement to maintain entry status is unrelated to the qualification determination. For example, a player may have qualified for the multiplayer game based on a player status, and in order to maintain their entry status must meet a requirement tied to game play statistics. In one alternative, a player may qualify based on game play statistics, and another game play statistic or a modified game play statistic is used as the requirement to maintain entry status. If the player fails to maintain their entry status 218(NO), the player is disqualified at 220.

At step 222 the multiplayer game is executed. The multiplayer game may take many forms. In one example, the multiplayer game is a bingo multiplayer game. In another embodiment the multiplayer game is a tournament game. Other multiplayer games may include elements of chance, elements of skill, or a combination thereof. In one example, the multiplayer game is a best of 100 hands of blackjack, with the participant who performs the best over 100 hands receiving the jackpot.

In a typical embodiment, the multiplayer game is executed over a large player population, i.e. a large number of players are qualified to participate in the multiplayer game. In one embodiment, the primary source of funding for the multiplayer game is derived separately from the wagers entered on the underlying games on which a player may qualify and/or maintain an entry status in the multiplayer game. Although one should appreciate according to at least one embodiment, funds from the underlying games at a gambling location are indirectly used, at least to some extent, in funding the multiplayer game. At step 224, a winner from amongst the qualified participants is determined and announced.

Figure 3:
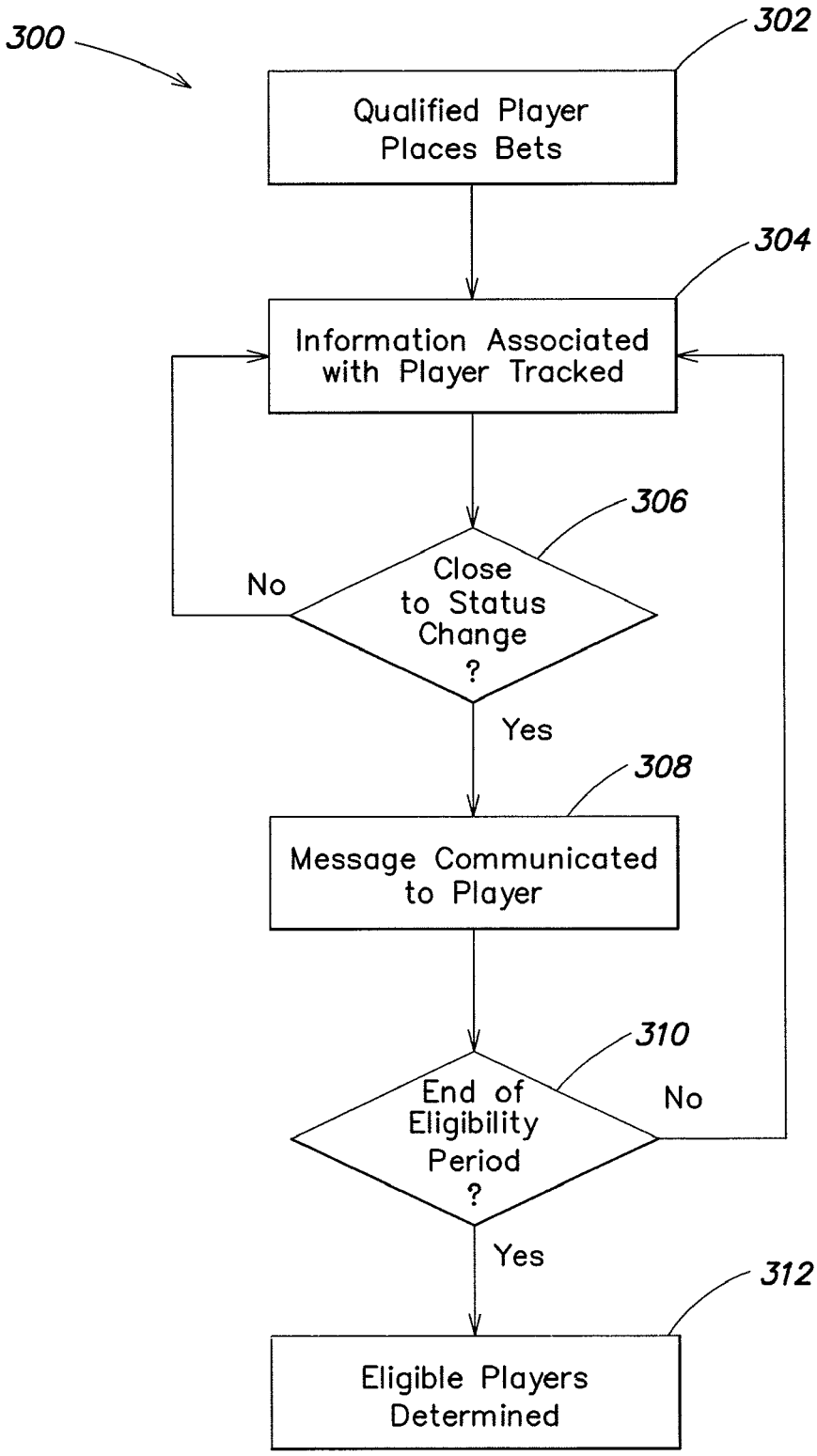
FIG. 3 shows a process for providing player messages according to another embodiment of the present invention.

With respect to FIG. 3, shown is an example of a process, 300, for delivery of messages to a player regarding an entry status. According to one aspect, once a player has qualified to participate in a multiplayer jackpot game, that player may be required to maintain their entry status in order to be eligible for a prize in the multiplayer game. It is realized that that award of an invitation coupled with the requirement to maintain the entry may be used to incent a player to play more, continue play, play faster, place larger bets, place additional bets as some examples. At step 302, a qualified player places bets on a gaming machine. At step 304, information associated with the player is tracked.

At step 306, a determination regarding the players entry status. At 306(NO) it is determined that the player is not close to a status change and tracking continues at 304. One should appreciate that a player need not receive a message, which generally would indicate a positive result for a test for eligibility. At 306(YES), it is determined that the player is close to a status change. The status change may be associated with losing qualification in the multiplayer game or may be associated with qualifying for a different and/or additional multiplayer game. In one example, a player may have qualified for a multiplayer game with a $10K jackpot to be awarded in the next 10 minutes, and during the course of continued play, the player is close to meeting another qualification (i.e. close to status change at 306(YES)) for a $15K jackpot to be awarded in the next 15 minutes. In one embodiment, the player receives a message, at 308, indicating the acts needed to be performed to qualify for the larger jackpot multiplayer game. In another embodiment, the player may qualify for both multiplayer games. In yet another embodiment, qualification may be made exclusive and a player may not qualify for more than one simultaneous and/or overlapping multiplayer game.

In one example, the status change indicates that a player is close to losing qualification for the multiplayer game. At 306(YES) a player rate of play has fallen so the player is close to losing qualification. At 308 a message is communicated to the player via a display attached to a gaming machine that the player must increase rate of play to maintain qualification. In one example, the message identifies the number of games that need to be played, in another the number of credits to wager in a specified time period, etc.

At 310, it is determined whether the period for maintaining an entry status is over. At 310(NO), the end of the eligibility period has not ended and process 300 continues at 304. At 310(YES), the period for eligibility concludes and all eligible players are determined at 312.

Figure 4:
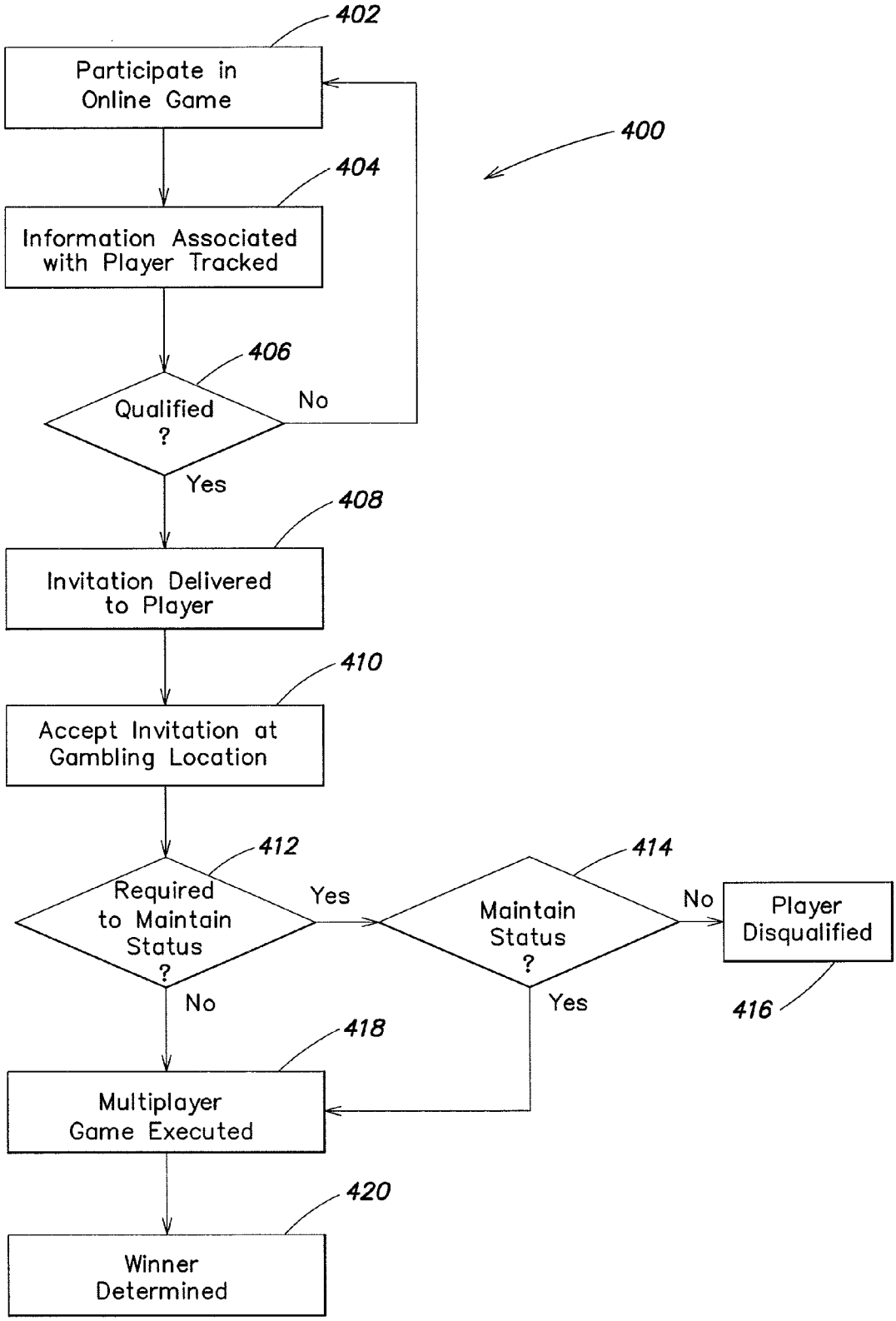
FIG. 4 shows a process for providing player incentive according to another embodiment of the present invention.

With respect to FIG. 4, shown is an example of a process flow according to some aspects of the present invention. Process 400, illustrates one example flow for providing an incentive to a player in the form of a multiplayer jackpot game. At step 402, a player participates in an online game. At step 404 information associated with the player is tracked, and at 406, it is determined if the player meets a qualification, 406(YES) or does not 406(NO). After determining the player is qualified 406(YES), the player receives an invitation to participate in a multiplayer game at 408. Typically the invitation will indicate that the player must redeem the invitation at a gambling location. The invitation may specify a particular gambling location, or may provide multiple locations at which a invitation may be accepted. At 410, a player accepts the invitation at a gambling location. In one example, acceptance comes in the form of providing information about the player for tracking purposes. In another example, a player may be issued a unique identifier at the gambling location as part of the process of acceptance. In yet another example, a unique identifier is printed on the invitation, and the invitation itself may be used for tracking purposes.

If a player is required to maintain an entry status for the multiplayer game, 412(YES), according to a requirement, a determination is made at step 414 whether 414(YES) or not 414(NO) the player has satisfied the requirement. If the player does not 414(NO) the player is disqualified at 416. Optionally, a player may be permitted to requalify for the multiplayer game within a specified time (not shown). If the player maintained their status 414(YES), the multiplayer game is executed at 418 for the eligible players. In one embodiment, the multiplayer game is executed in conjunction with the determination of entry status and the multiplayer game and the requirement for maintaining entry status proceed concurrently. According to one embodiment, at the conclusion of the multiplayer game, at least one winner is determined from the participant in the multiplayer game, at 420.

The processes described above are merely illustrative embodiments of a method for providing incentives a player. Such illustrative embodiments are not intended to limit the scope of the invention, as any of numerous other implementations for performing the invention. None of the claims set forth below are intended to be limited to any particular implementation of a method of providing player incentives, unless such claim includes a limitation explicitly reciting a particular implementation.

Processes and methods associated with various embodiments, acts thereof and various embodiments and variations of these methods and acts, individually or in combination, may be defined by computer-readable signals tangibly embodied on a computer-readable medium, for example, a non-volatile recording medium, an integrated circuit memory element, or a combination thereof. Such signals may define instructions, for example, as part of one or more programs, that, as a result of being executed by a computer, instruct the computer to perform one or more of the methods or acts described herein, and/or various embodiments, variations and combinations thereof. Such instructions may be written in any of a plurality of programming languages, for example, Java, Visual Basic, C, C#, or C++, Fortran, Pascal, Eiffel, Basic, COBOL, etc., or any of a variety of combinations thereof. The computer-readable medium on which such instructions are stored may reside on one or more of the components of a general-purpose computer described above, and may be distributed across one or more of such components.

The computer-readable medium may be transportable such that the instructions stored thereon can be loaded onto any computer system resource to implement the aspects of the present invention discussed herein. In addition, it should be appreciated that the instructions stored on the computer-readable medium, described above, are not limited to instructions embodied as part of an application program running on a host computer. Rather, the instructions may be embodied as any type of computer code (e.g., software or microcode) that can be employed to program a processor to implement the above-discussed aspects of the present invention.

Figure 8:
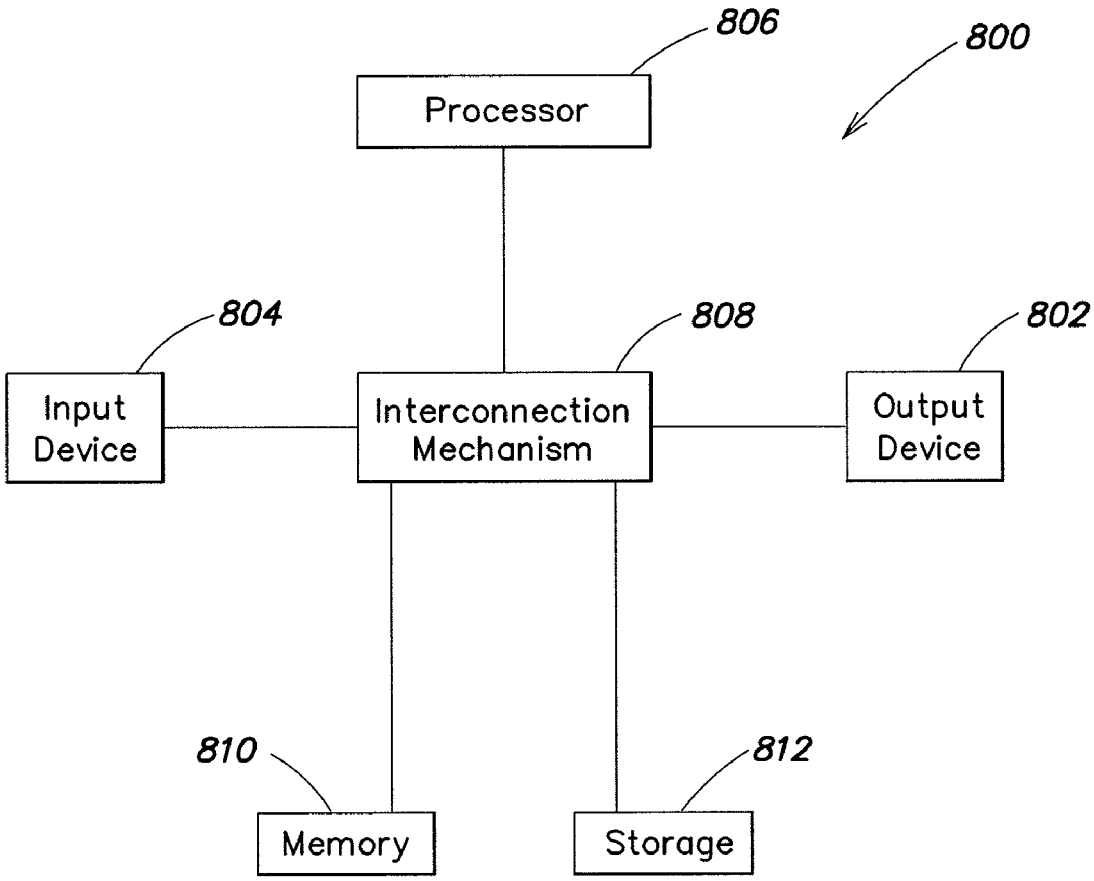
FIG. 8 is a block diagram of a system for providing a multiplayer incentive according to one embodiment of the present invention.

Various embodiments according to the invention may be implemented on one or more computer systems, e.g. system 800, FIG. 8. These computer systems may be, for example, general-purpose computers such as those based on Intel PENTIUM-type processor, Motorola PowerPC, Sun UltraSPARC, Hewlett-Packard PA-RISC processors, or any other type of processor. It should be appreciated that one or more of any type computer system may be used to partially or fully automate play of the described game according to various embodiments of the invention. Further, the software design system may be located on a single computer or may be distributed among a plurality of computers attached by a communications network.

The computer system 800 may include specially-programmed, special-purpose hardware, for example, an application-specific integrated circuit (ASIC). Aspects of the invention may be implemented in software, hardware or firmware, or any combination thereof. Further, such methods, acts, systems, system elements and components thereof may be implemented as part of the computer system described above or as an independent component.

The computer system 800 includes a processor 806 connected to memory device 810. Memory 810 is typically used for storing programs and data during operation of the computer system 800. Components of computer system 800 are coupled by an interconnection mechanism 808. The interconnection mechanism 808 enables communications to be exchanged between system components of system 800. Computer system 800 also includes one or more input device 804, output device 802 for user interface with computer system 800.

Figure 9:
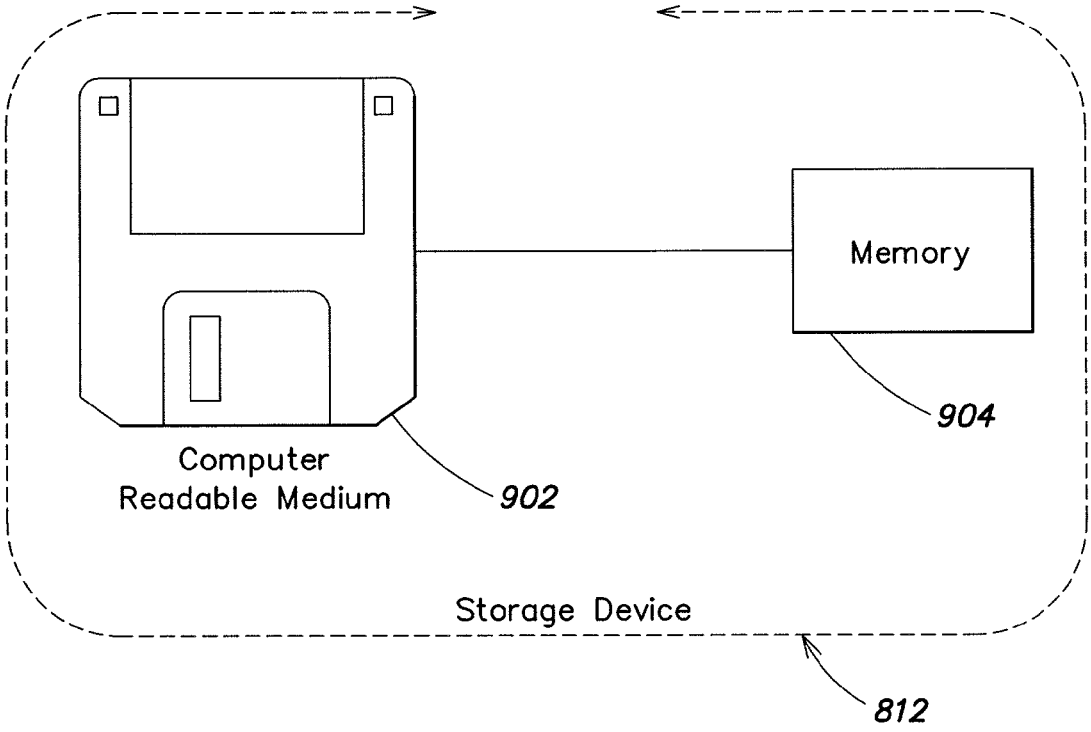
FIG. 9 is a block diagram of a system for providing a multiplayer incentive according to one embodiment of the invention.

Storage device 812, shown in greater detail in FIG. 9, typically includes a computer readable and writeable nonvolatile recording medium 902 in which signals are stored that define a program to be executed by the processor or information stored on or in the medium 902 to be processed by the program. Typically, in operation, the processor 806 causes data to be read from the nonvolatile recording medium 902 into another memory 904 that allows for faster access to the information by the processor than does the medium 902. This memory 904 includes a volatile, random access memory such as a dynamic random access memory (DRAM) or static memory (SRAM). Processor 806 generally manipulates the data within the integrated circuit memory 810, 904 and then copies the data to the medium 902 after processing is completed.

A computer system may be a general-purpose computer system that is programmable using a high-level computer programming language. Computer system may be also implemented using specially programmed, special purpose hardware. In a computer system there may be a processor that is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME), Windows XP, or Windows Visa operating systems available from the Microsoft Corporation, MAC OS System X available from Apple Computer, the Solaris Operating System available from Sun Microsystems, or UNIX available from various sources. Many other operating systems may be used.

The processor and operating system together define a computer platform for which application programs in high-level programming languages are written. It should be understood that the invention is not limited to a particular computer system platform, processor, operating system, or network. Also, it should be apparent to those skilled in the art that the present invention is not limited to a specific programming language or computer system. Further, it should be appreciated that other appropriate programming languages and other appropriate computer systems could also be used.

Figure 10:
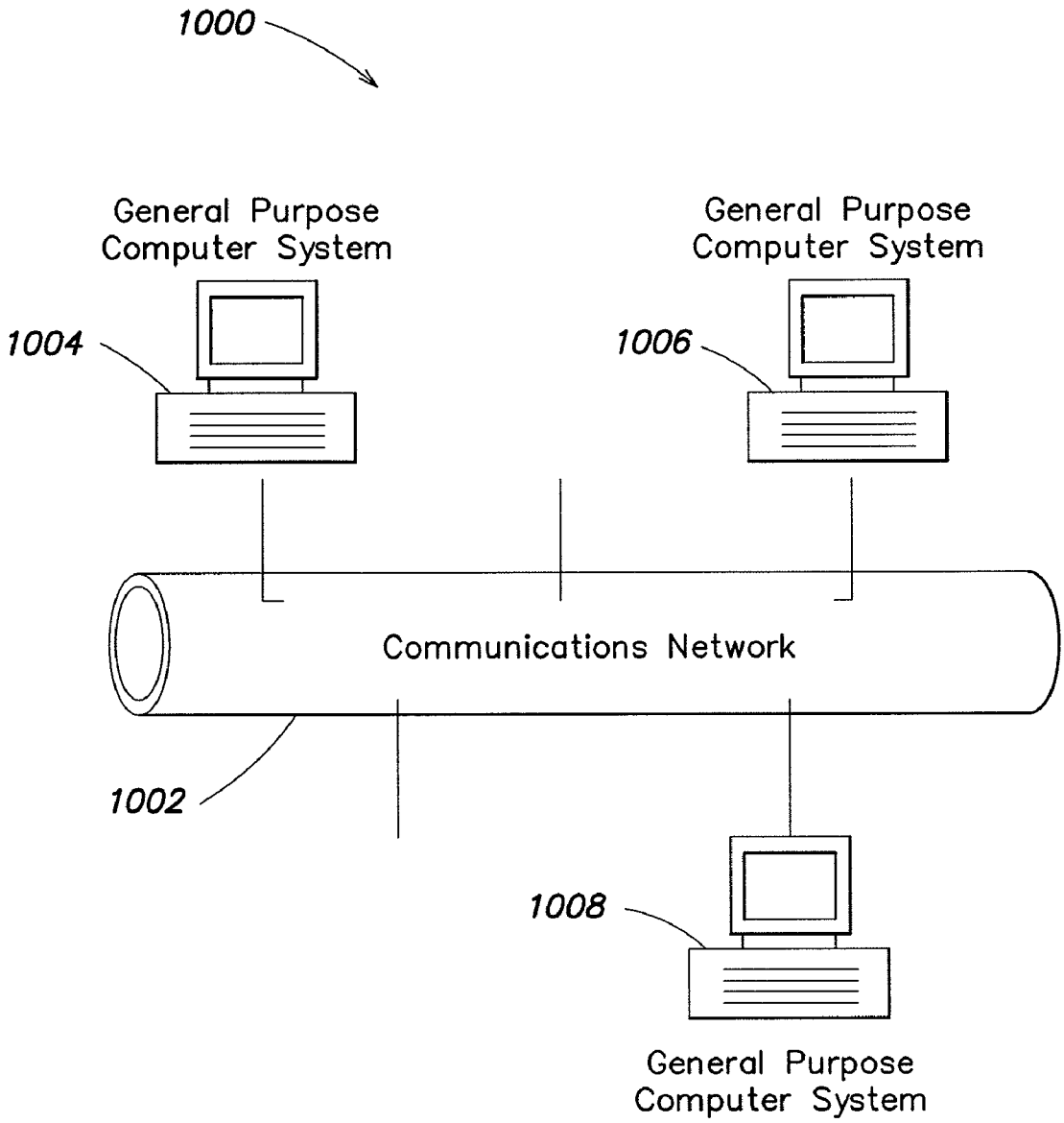
FIG. 10 is a block diagram of a system for providing a multiplayer incentive according to one embodiment of the invention.

One or more portions of the computer system may be distributed across one or more computer systems (1004-1008) coupled to a communications network, e.g. FIG. 10, 1002. These computer systems also may be general-purpose computer systems, e.g. 800. For example, various aspects of the invention may be distributed among one or more computer systems configured to provide a service (e.g., servers) to one or more client computers, or to perform an overall task as part of a distributed system, e.g. 1000. For example, various aspects of the invention may be performed on a client-server system that includes components distributed among one or more server systems that perform various functions according to various embodiments of the invention. These components may be executable, intermediate (e.g., IL) or interpreted (e.g., Java) code which communicate over a communication network (e.g., the Internet) using a communication protocol (e.g., TCP/IP).

It should be appreciated that the invention is not limited to executing on any particular system or group of systems. Also, it should be appreciated that the invention is not limited to any particular distributed architecture, network, or communication protocol.

Various embodiments of the present invention may be programmed using an object-oriented programming language, such as SmallTalk, Java, C++, Ada, or C# (C-Sharp). Other object-oriented programming languages may also be used. Alternatively, functional, scripting, and/or logical programming languages may be used. Various aspects of the invention may be implemented in a non-programmed environment (e.g., documents created in HTML, XML or other format that, when viewed in a window of a browser program, render aspects of a graphical-user interface (GUI) or perform other functions). Various aspects of the invention may be implemented as programmed or non-programmed elements, or any combination thereof.

Figure 5:
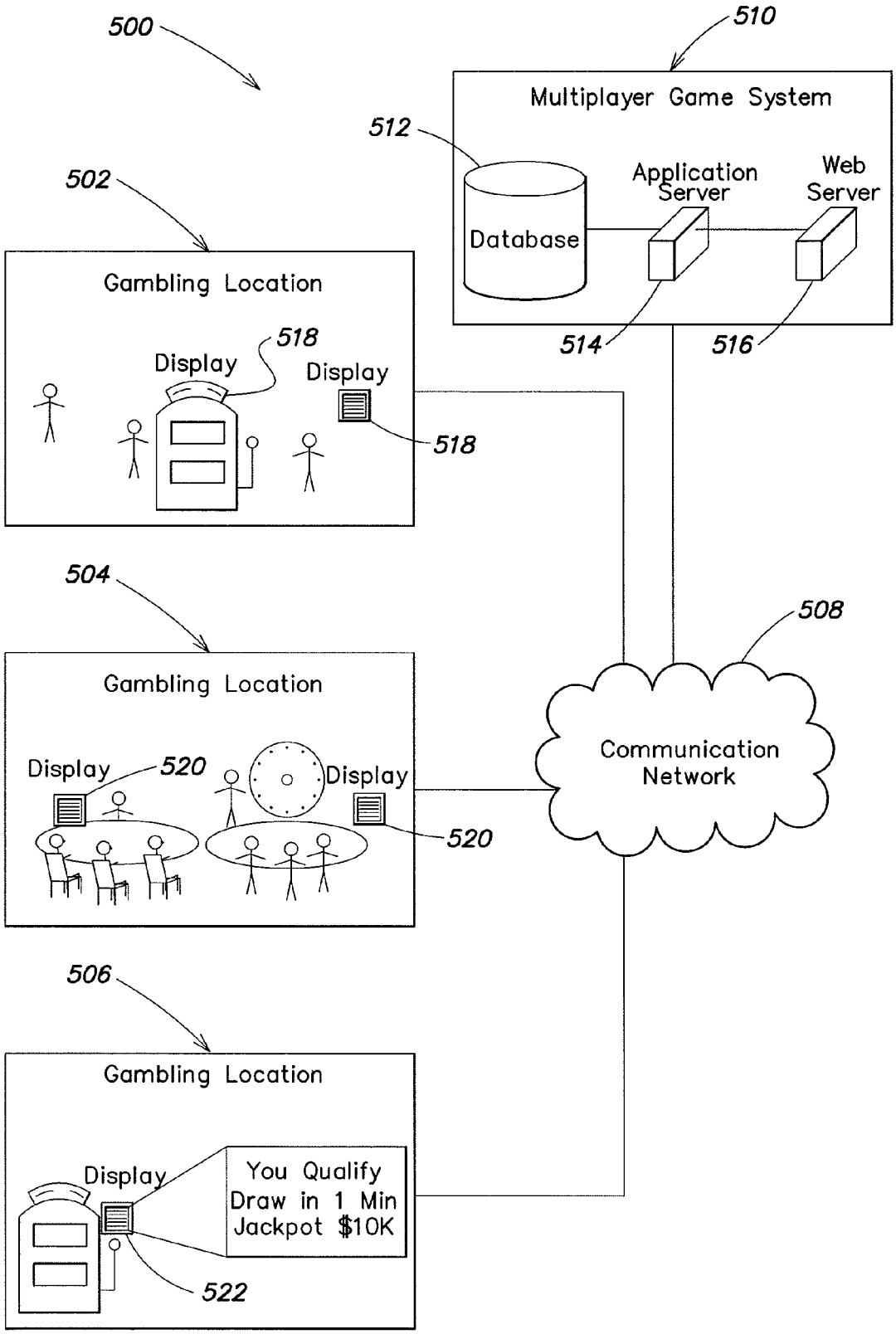
FIG. 5 shows an example embodiment of a system for implementing a multiplayer game over a number of gambling locations.

Shown in FIG. 5 is an example embodiment of a system 500 for implementing a multiplayer game over a number of gambling locations 502-506. In system 500, a plurality of gambling locations (502-506) are operatively connected to a communication network 508. System 500 includes an application server 514, a web server 516, and a database 512 to provide for multiplayer gaming across the plurality of connected locations, e.g. 502-506, and all of the players at those locations. System 500 can be used to route invitations and qualification messages to a multiplayer incentive game for display at displays 518-522. At displays 518-522 messages are provided to players. According to some embodiments, displays 518-522 render the game play of the multiplayer to participating players.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Further, for the one or more means-plus-function limitations recited in the following claims, the means are not intended to be limited to the means disclosed herein for performing the recited function, but are intended to cover in scope any means, known now or later developed, for performing the recited function.

As used herein, whether in the written description or the claims, the terms "comprising", "including", "containing", "characterized by" and the like are to be understood to be open-ended, i.e., to mean including but not limited to. Only the transitional phrases "consisting of" and "consisting essentially of", respectively, shall be closed or semi-closed transitional phrases, as set forth, with respect to claims, in the United States Patent Office Manual of Patent Examining Procedures (Eighth Edition 2nd Revision, May 2004), Section 2111.03.

Use of ordinal terms such as "first", "second", "third", "a", "b" "c" etc., in the claims to modify or otherwise identify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A computer implemented method for providing a player incentive, the method comprising:

providing, via a display device, an invitation to a player to enter a multiplayer game;

determining, by executing instructions stored in a memory device, a threshold associated with providing the invitation;

determining, by executing instructions stored in a memory device, a player satisfies the threshold;

displaying, via the display device, to the player a status of an entry into the multiplayer game that includes an indication that the player is qualified to participate in the multiplayer game;

determining, by executing instructions stored in a memory device, if the player meets a requirement necessary to maintain the qualified to participate status during play of the multiplayer game such that the player may continue to play the multiplayer game as long as the qualified to participate status is maintained wherein the requirement comprises at least one action the player must perform during play of the multiplier game that is separate from and unrelated to play of the multiplayer game; and determining, by executing instructions stored in a memory device, a winning entry from a plurality of entries into the multiplayer game.

2. The method according to claim 1, wherein the act of displaying further comprises displaying the status of the entry in response to play of another game.

3. The method according to claim 2, wherein the play of the another game occurs at a gambling location.

4. The method according to claim 2, wherein the winning entry is determined independently of game play of the another game.

5. The method according to claim 1, wherein the requirement is based, at least in part on gambling metrics, including at least one of time spent gambling, size of wager, number of credits wagered, number of credits wagered over time, average number of wagers over time, average size of wager, coin in, average coin in, player club status, money lost, money won, a number of trips to the gambling location, duration of a trip to the gambling location, and average duration of a trip to the gambling location, time spent gaming, and average time spent gaming.

6. The method according to claim 1, further comprising an act of determining a frequency for execution of the multiplayer game.

7. The method according to claim 1, wherein the act of providing occurs in response to at least one of play of an online computer-based game and play of a game at a gambling location.

8. The method according to claim 1, further comprising an act of determining a requirement for redeeming the invitation.

9. The method according to claim 8, wherein the requirement comprises at least one of redeeming the invitation according to a time constraint, playing a game specified in the invitation according to a time constraint, redeeming an invitation at a specified location, playing a game at a specified location, redeeming an invitation at a specified location and according to a time constraint, and playing a game at a specified location and according to a time constraint.

10. The method according to claim 1, further comprising an act of determining the winning entry into the multiplayer game at the gambling location.

11. The method according to claim 1, further comprising an act of determining a plurality of qualified entries into the multiplayer game.

12. The method according to claim 11, wherein the act determining a winning entry from a plurality of entries into the multiplayer game occurs in response to at least one of determining the plurality of qualified entries and determining that the player met a requirement to maintain the entry status.

13. The method according to claim 1, further comprising an act of displaying to the player the status of the entry into the multiplayer game in substantially real time.

14. The method according to claim 13, further comprising the acts of:

updating the entry status; and displaying the entry status in response to updating.

15. The method according to claim 1, further comprising an act of updating the entry status until the act of determining the winning entry from the plurality of entries into the multiplayer game occurs.

16. The method according to claim 1, further comprising the acts of:

determining a plurality of qualified entries into the multiplayer game; and updating the entry status until the act of determining the plurality of qualified entries occurs.

17. The method according to claim 1, further comprising an act of displaying a message associated with the status of the entry to the player, wherein the message includes at least one of an indication that the player is close to qualifying for the multiplayer game, an indication that the player is close to losing qualification for the multiplayer game, an indication of how the player may maintain the status of the entry for the multiplayer game, and an indication of an opportunity to qualify for another multiplayer game.

18. The method according to claim 2, wherein the multiplayer game is funded separately from the another game.

19. The method according to claim 2, wherein the multiplayer game is funded independently from player contribution to the another game.

20. The method according to claim 1, wherein the multiplayer game includes a large number of entries.

21. The method according to claim 1, wherein the act of providing the invitation occurs across a large population of players for each multiplayer game.

22. The method according to claim 1, wherein a number of invitations exceeds a maximum number of players associated with conventional casino table based games.

23. The method according to claim 1, wherein a number of players participating in each multiplayer game is at least on the order of a number of players participating in a progressive type game.

24. The method according to claim 15, further comprising an act of disqualifying the player based on the updating of the status of the entry.

25. The method according to claim 1, wherein the player may requalify for entry into the multiplayer game after being disqualified from participating in the multiplayer game.

26. The method according to claim 1, wherein the player may requalify for entry into the multiplayer game after failing to maintain the qualified-to-participate status during play of the multiplayer game.

27. A non-transitory computer-readable medium having computer-readable signals stored thereon that define instructions that, as a result of being executed by a computer, instruct the computer to perform a method providing a player incentive, the method comprising:

providing an invitation to a player to enter a multiplayer game;

determining a threshold associated with providing the invitation;

determining a player satisfies the threshold;

displaying to the player a status of an entry into the multiplayer game that includes an indication that the player is qualified to participate in the multiplayer game;

determining if the player meets a requirement necessary to maintain the qualified to participate status during play of the multiplayer game such that the player may continue to play the multiplayer game as long as the qualified to participate status is maintained, wherein the requirement comprises at least one action the player must perform during play of the multiplier game that is separate from and unrelated to play of the multiplayer game; and determining a winning entry from a plurality of entries into the multiplayer game.

28. A system for providing a multiplayer incentive game, the system comprising:

a storage component adapted to store criteria associated with an invitation to a multiplayer game;

an analysis engine adapted to determine satisfaction of a threshold associated with the invitation to a multiplayer game;

a communication component adapted to deliver in invitation to a multiplayer game in response to the determination that a player satisfies the threshold;

a redemption component adapted to accept the invitation;

a game engine adapted to display to a player the status of an entry into the multiplayer game that includes an indication that the player is qualified to participate in the multiplayer game;

the analysis engine adapted to determine if the player meets a requirement necessary to maintain the qualified to participate status during play of the multiplayer game such that the player may continue to play the multiplayer game as long as the qualified to participate status is maintained, wherein the requirement comprises at least one action the player must perform during play of the multiplier game that is separate from and unrelated to play of the multiplayer game; and wherein game engine is further adapted to display the multiplayer game and a winner of the multiplayer game.

29. The system according to claim 28, wherein the game engine is further adapted to conduct the multiplayer game for a large number of entries.

30. The system according to claim 28, wherein the communication component is further adapted to deliver invitations across a large population of players for each multiplayer game.

31. The system according to claim 28, wherein the redemption component is further adapted to require redemption at a gambling location.

* * * * *